US009010977B2

(12) United States Patent
Harbers et al.

(10) Patent No.: US 9,010,977 B2
(45) **Date of Patent: *Apr. 21, 2015**

(54) LED-BASED ILLUMINATION MODULE ATTACHMENT TO A LIGHT FIXTURE

(71) Applicant: Xicato, Inc., San Jose, CA (US)

(72) Inventors: Gerard Harbers, Sunnyvale, CA (US); Gregory W. Eng, Fremont, CA (US); Christopher R. Reed, Campbell, CA (US); Peter K. Tseng, San Jose, CA (US); John S. Yriberri, San Jose, CA (US)

(73) Assignee: Xicato, Inc., San Jose, CA (US)

( * ) Notice: Subject to any disclaimer, the term of this patent is extended or adjusted under 35 U.S.C. 154(b) by 91 days.

This patent is subject to a terminal disclaimer.

(21) Appl. No.: 13/627,872

(22) Filed: Sep. 26, 2012

(65) Prior Publication Data

US 2013/0021808 A1 Jan. 24, 2013

Related U.S. Application Data

(63) Continuation of application No. 13/181,794, filed on Jul. 13, 2011, now Pat. No. 8,292,482, which is a continuation of application No. 13/088,710, filed on Apr. 18, 2011, now Pat. No. 7,988,336.

(60) Provisional application No. 61/328,120, filed on Apr. 26, 2010.

(51) Int. Cl.
*F21V 7/04* (2006.01)
*F21V 29/00* (2006.01)
(Continued)

(52) U.S. Cl.
CPC ..... *F21V 29/004* (2013.01); *F21K 9/00* (2013.01); *F21V 19/045* (2013.01);
(Continued)

(58) Field of Classification Search
USPC ..... 362/249.1, 249.02, 294, 547, 549
See application file for complete search history.

(56) References Cited

U.S. PATENT DOCUMENTS 1,049,533 A 1/1913 Risinger
1,266,818 A 5/1918 Kirschbaum
(Continued)

FOREIGN PATENT DOCUMENTS

DE 20 2006 002 583 U1 6/2007
DE 10 2007 038787 A1 2/2009
(Continued)

OTHER PUBLICATIONS

Machine Translation in English of Abstract of DE 10 2007 038787 A1 visited at www.espacenet.com on May 28, 2013, 2 pages.
(Continued)

*Primary Examiner* — Ali Alavi
(74) *Attorney, Agent, or Firm* — Silicon Valley Patent Group LLP

(57) ABSTRACT

A mounting collar on a light fixture provides a compressive force between the illumination module and a light fixture. For example, a mounting collar that is fixed to the light fixture may engage with an illumination module to deform elastic mounting members on the illumination module to generate the compressive force. The mounting collar may include tapered features on first and second members that are moveable with respect to each other and that when engaged generate the compressive force. The mounting collar may include elastic mounting members on first and second members that move with respect to each other, wherein the movement deforms the elastic mounting members to generate the compressive force. The mounting collar may include an elastic member, wherein movement movement of the mounting collar relative to a light fixture deforms the elastic member to generate the compressive force.

20 Claims, 20 Drawing Sheets

(51) Int. Cl.

| | |
|---|---|
| ***F21K 99/00*** | (2010.01) |
| ***F21V 19/04*** | (2006.01) |
| *F21Y 101/02* | (2006.01) |
| *F21V 17/14* | (2006.01) |
| *F21V 29/02* | (2006.01) |
| *F21V 7/20* | (2006.01) |

(52) U.S. Cl.
CPC ..... *F21Y 2101/02* (2013.01); *F21V 17/14* (2013.01); *F21V 29/2206* (2013.01); *F21V 29/2231* (2013.01); *F21V 29/246* (2013.01); *F21V 29/027* (2013.01); *F21V 7/20* (2013.01)

(56) References Cited

U.S. PATENT DOCUMENTS

| | | | | |
|---|---|---|---|---|
| 1,374,735 | A | 4/1921 | Harvey | |
| 1,427,344 | A | 8/1922 | Barclay | |
| 4,173,037 | A | 10/1979 | Henderson, Jr. et al. | |
| 4,829,408 | A | 5/1989 | Haydu | |
| 4,851,976 | A | 7/1989 | McMahan et al. | |
| 4,999,750 | A | 3/1991 | Gammache | |
| 5,315,490 | A | 5/1994 | Bastable | |
| 5,582,479 | A | 12/1996 | Thomas et al. | |
| 5,959,316 | A | 9/1999 | Lowery | |
| 6,351,069 | B1 | 2/2002 | Lowery et al. | |
| 6,504,301 | B1 | 1/2003 | Lowery | |
| 6,586,882 | B1 | 7/2003 | Harbers | |
| 6,600,175 | B1 | 7/2003 | Baretz et al. | |
| 6,634,616 | B2 | 10/2003 | Belknap | |
| 6,680,569 | B2 | 1/2004 | Mueller-Mach et al. | |
| 6,812,500 | B2 | 11/2004 | Reeh et al. | |
| 7,126,162 | B2 | 10/2006 | Reeh et al. | |
| 7,145,179 | B2 | 12/2006 | Petroski | |
| 7,250,715 | B2 | 7/2007 | Mueller et al. | |
| 7,275,846 | B2 | 10/2007 | Browne et al. | |
| 7,405,944 | B2 | 7/2008 | Mayer et al. | |
| 7,479,662 | B2 | 1/2009 | Soules et al. | |
| 7,540,761 | B2 | 6/2009 | Weber et al. | |
| 7,564,180 | B2 | 7/2009 | Brandes | |
| 7,614,759 | B2 | 11/2009 | Negley | |
| 7,629,621 | B2 | 12/2009 | Reeh et al. | |
| 7,740,380 | B2 | 6/2010 | Thrailkill | |
| 7,866,845 | B2 | 1/2011 | Man | |
| 7,988,336 | B1 * | 8/2011 | Harbers et al. | 362/294 |
| 8,292,482 | B2 * | 10/2012 | Harbers et al. | 362/547 |
| 8,348,478 | B2 | 1/2013 | Pelton et al. | |
| 8,500,299 | B2 | 8/2013 | Speidel et al. | |
| 8,858,045 | B2 | 10/2014 | Harbers et al. | |
| 2004/0212991 | A1 | 10/2004 | Galli | |
| 2005/0276053 | A1 | 12/2005 | Nortrup et al. | |
| 2006/0221620 | A1 | 10/2006 | Thomas | |
| 2007/0081336 | A1 | 4/2007 | Bierhuizen et al. | |
| 2007/0109751 | A1 | 5/2007 | Mayer et al. | |
| 2007/0253202 | A1 | 11/2007 | Wu et al. | |
| 2007/0279921 | A1 | 12/2007 | Alexander et al. | |
| 2008/0130275 | A1 | 6/2008 | Higley et al. | |
| 2008/0298056 | A1 | 12/2008 | Petersen | |
| 2009/0129086 | A1 | 5/2009 | Thompson, III | |
| 2009/0213595 | A1 | 8/2009 | Alexander et al. | |
| 2011/0019409 | A1 | 1/2011 | Wronski | |
| 2011/0063837 | A1 | 3/2011 | Rizkin et al. | |
| 2011/0140633 | A1 | 6/2011 | Archenhold | |
| 2011/0267822 | A1 | 11/2011 | Harbers et al. | |
| 2012/0038293 | A1 | 2/2012 | Guerrieri et al. | |
| 2013/0044501 | A1 | 2/2013 | Rudisill et al. | |

FOREIGN PATENT DOCUMENTS

| | | | |
|---|---|---|---|
| DE | 20 2010 000 007 | U1 | 3/2010 |
| EP | 1 826 480 | A1 | 8/2007 |
| JP | 2001-298881 | A | 10/2001 |
| JP | 2004-265619 | A | 9/2004 |
| JP | 2007-247931 | A | 9/2007 |
| JP | 2007-287649 | A | 11/2007 |
| WO | WO 2004/071143 | A1 | 8/2004 |
| WO | WO 2010/044011 | A1 | 4/2010 |
| WO | WO 2011/025244 | A2 | 3/2011 |

OTHER PUBLICATIONS

Invitation to Pay Additional Fees mailed on Oct. 13, 2011 for International Application No. PCT/US2011/032917 filed on Apr. 18, 2011, seven pages.

International Search Report and Written Opinion mailed on Dec. 12, 2011 for International Application No. PCT/US2011/032917 filed on Apr. 18, 2011, 20 pages.

Notice of Allowance mailed on Jun. 23, 2011 for U.S. Appl. No. 13/088,710, filed Apr. 18, 2011, 11 pages.

Office Action mailed on Mar. 6, 2012 for U.S. Appl. No. 13/181,794, filed Jul. 13, 2011, 8 pages.

Response to Office Action mailed on Jun. 5, 2012 for U.S. Appl. No. 13/181,794, filed Jul. 13, 2011, 9 pages.

Notice of Allowance mailed on Jun. 22, 2012 for U.S. Appl. No. 13/181,794, filed Jul. 13, 2011, 7 pages.

Machine Translation in English of Abstract of JP 2001-298881 visited at www.espaceuet.com on Jan. 29, 2015, 2 pages.

Machine Translation in English of Abstract of JP 2004-265619 visited at www.espacenet.com on Jan. 29, 2015, 2 pages.

Machine Translation in English of Abstract of JP 2007-247931 visited at www.espacenet.com on Jan. 29, 2015, 2 pages.

Machine Translation in English of Abstract of JP 2007-287649 visited at wwwespaceriet.com on Jan. 29, 2015, 2 pages.

* cited by examiner

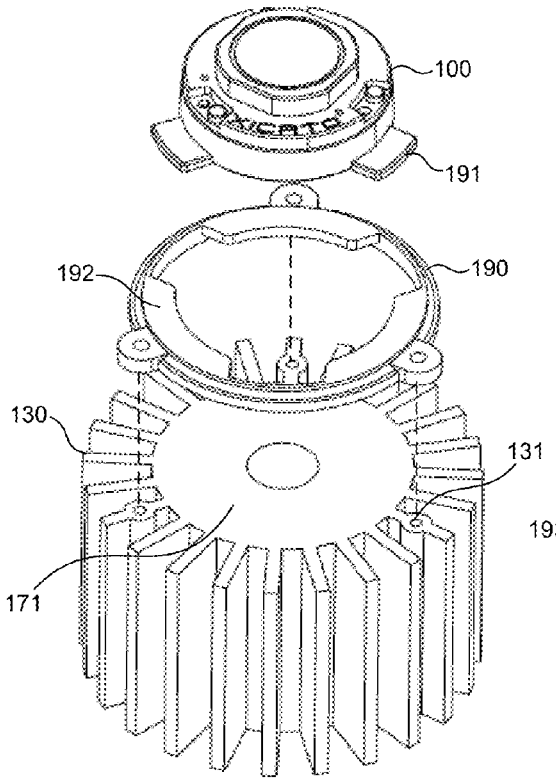
FIG. 14A
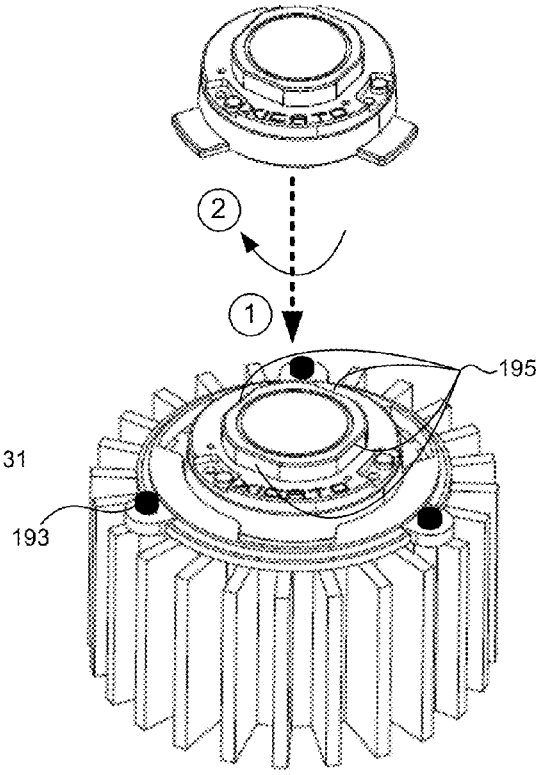
FIG. 14B
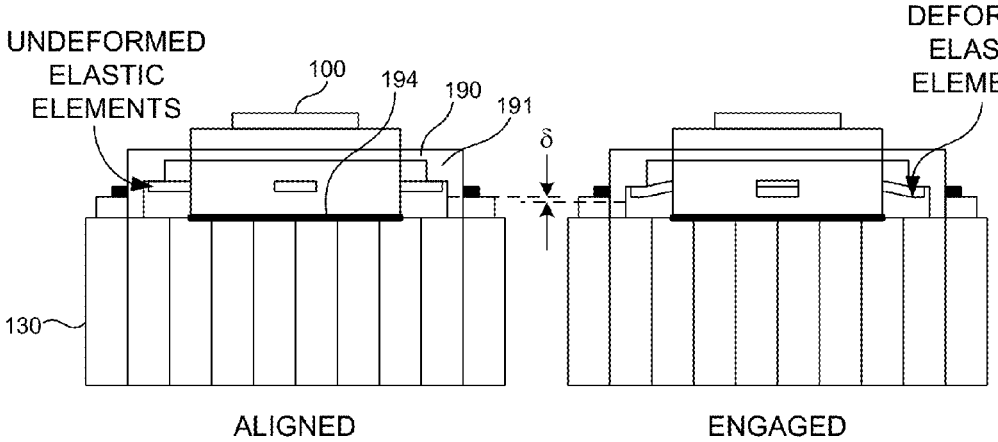
FIG. 15A
FIG. 15B

LOCK WITH TOOL

UNLOCK WITH TOOL

LED-BASED ILLUMINATION MODULE ATTACHMENT TO A LIGHT FIXTURE

CROSS REFERENCE TO RELATED APPLICATIONS

This application is a continuation of U.S. patent application Ser. No. 13/181,794, filed Jul. 13, 2011, which, in turn, is a continuation of U.S. patent application Ser. No. 13/088,710, filed Apr. 18, 2011, now U.S. Pat. No. 7,988,336, issued Aug. 2, 2011, which, in turn claims the benefit of U.S. Provisional Application No. 61/328,120, filed Apr. 26, 2010, all of which are incorporated by reference herein in their entireties.

TECHNICAL FIELD

The described embodiments relate to illumination modules that include Light Emitting Diodes (LEDs).

BACKGROUND INFORMATION

The use of LEDs in general lighting is becoming more desirable. Illumination devices that include LEDs typically require large amounts of heat sinking and specific power requirements. Consequently, many such illumination devices must be mounted to light fixtures that include heat sinks and provide the necessary power. The typically connection of an illumination devices to a light fixture, unfortunately, is not user friendly. Consequently, improvements are desired.

SUMMARY

The interface between an illumination module and a light fixture may be provided by a mounting collar interface that is mounted on the light fixture and that produces a compressive force between the illumination module and a light fixture when engaged with the illumination module. For example, the mounting collar may engage with an illumination module to deform elastic mounting members on the illumination module to generate the compressive force. The mounting collar may include tapered features on first and second members that are moveable with respect to each other and that when engaged generate the compressive force. The mounting collar may include elastic mounting members on first and second members that move with respect to each other, wherein the movement deforms the elastic mounting members to generate the compressive force. The mounting collar may include an elastic member, wherein movement of the mounting collar relative to a light fixture deforms the elastic member to generate the compressive force.

BRIEF DESCRIPTION OF THE DRAWINGS

FIGS. 14A-15B illustrate a third embodiment suited for convenient removal and installation of an LED based illumination module in a luminaire.

DETAILED DESCRIPTION

Reference will now be made in detail to background examples and some embodiments of the invention, examples of which are illustrated in the accompanying drawings.

Figure 1A:
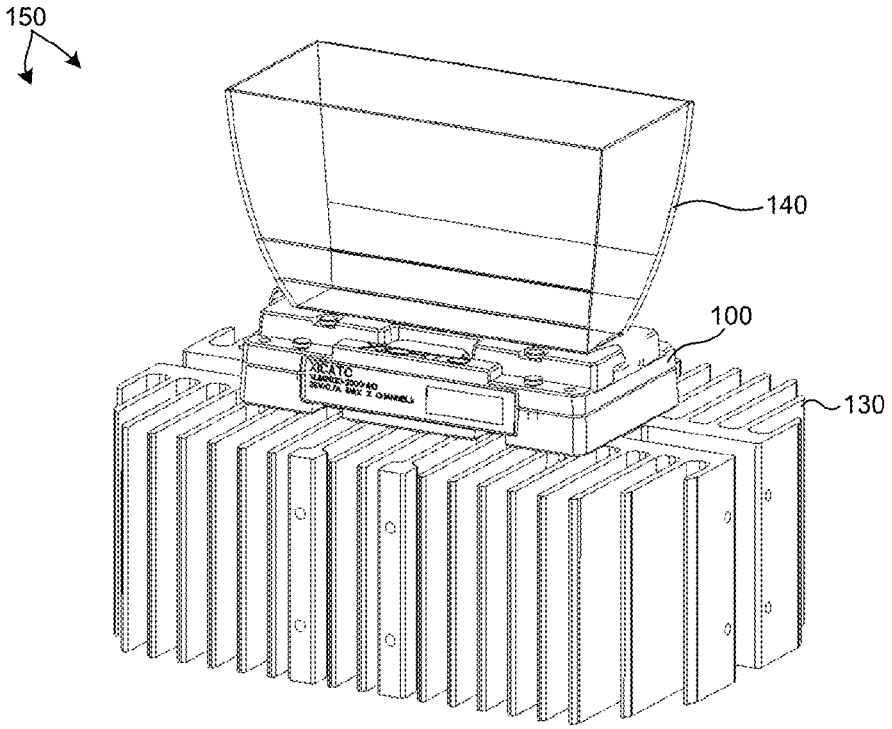
FIGS. 1A and 1B illustrate two exemplary luminaires, including an illumination module, reflector, and light fixture.
Figure 1B:
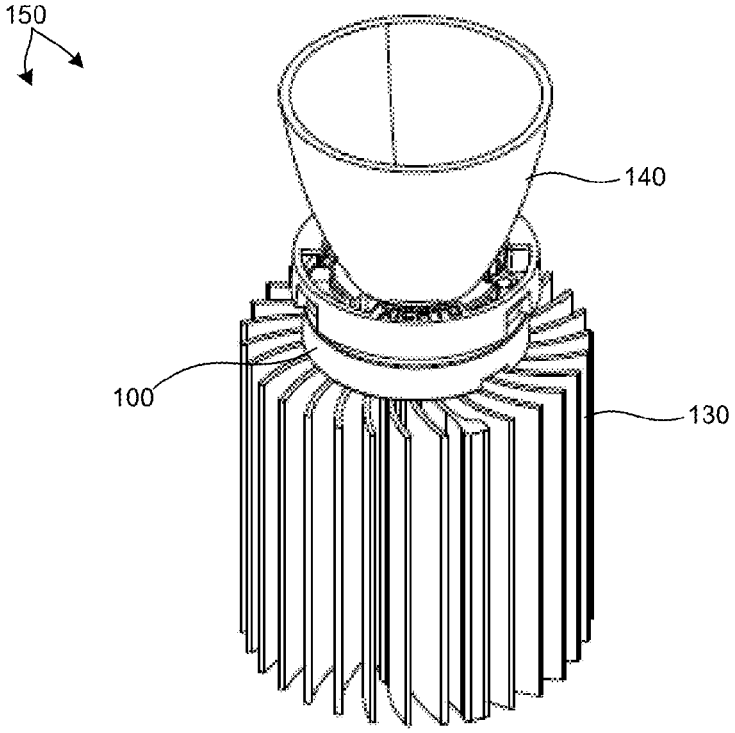

FIGS. 1A-B illustrate two exemplary luminaires. The luminaire illustrated in FIG. 1A includes an illumination module 100 with a rectangular form factor. The luminaire illustrated in FIG. 1B includes an illumination module 100 that is circular in form. These examples are for illustrative purposes. Examples of illumination modules of general polygonal and round shapes may also be contemplated. Luminaire 150 includes LED based illumination module 100, reflector 140, and light fixture 130. Light fixture 130 may take many different forms in differing luminaire designs. In many examples, light fixture 130 includes electrical interconnect hardware, structural elements to facilitate the physical installation of the luminaire, and other structural and decorative elements (not shown). In general, light fixture 130 performs a heat sinking function. Heat generated by an illumination module 100 coupled to the light fixture 130 is dissipated by the light fixture 130. For simplicity, light fixture 130 is depicted as a basic heat sink structure in the drawings associated with this patent document. For this reason, the terms "heat sink" and "light fixture" are used interchangeably throughout this patent document. However, it should be understood that a light fixture 130 may include additional elements and perform additional functions besides heat dissipation. In many cases, light fixture 130 is a much more fanciful design than depicted in this patent document. Thus, the use of the term "heat sink" and the depictions of this patent document are not meant to be limited to light fixtures 130 that include only a heat sink structure.

Reflector 140 is mounted to illumination module 100 to collimate light emitted from illumination module 100. The reflector 140 may be made out of a thermally conductive material, such as a material that includes aluminum or copper and may be thermally coupled to illumination module 100. Heat flows by conduction through illumination module 100 and the thermally conductive reflector 140. Heat also flows via thermal convection over the reflector 140. Reflector 140 may be a compound parabolic concentrator, where the concentrator is made out of a highly reflecting material. Compound parabolic concentrators tend to be tall, but they often are used in a reduced length form, which increases the beam angle. An advantage of this configuration is that no additional diffusers are required to homogenize the light, which increases the throughput efficiency. Optical elements, such as a diffuser or reflector 140 may be removably coupled to illumination module 100, e.g., by means of threads, a clamp, a twist-lock mechanism, or other appropriate arrangement.

Illumination module 100 is mounted to light fixture 130. As depicted in FIGS. 1A and 1B, illumination module 100 is mounted to heat sink 130. Heat sink 130 may be made from a thermally conductive material, such as a material that includes aluminum or copper and may be thermally coupled to illumination module 100. Heat flows by conduction through illumination module 100 and the thermally conductive heat sink 130. Heat also flows via thermal convection over heat sink 130. Illumination module 100 may be attached to heat sink 130 by way of screw threads to clamp the illumination module 100 to the heat sink 130. To facilitate easy removal and replacement of illumination module 100, illumination module 100 may be removably coupled to heat sink 130 as discussed in this patent document, e.g., by means of a clamp mechanism, a twist-lock mechanism, or other appropriate arrangement. Illumination module 100 includes at least one thermally conductive surface that is thermally coupled to heat sink 130, e.g., directly or using thermal grease, thermal tape, thermal pads, or thermal epoxy. For adequate cooling of the LEDs, a thermal contact area of at least 50 square millimeters, but preferably 100 square millimeters should be used per one watt of electrical energy flow into the LEDs on the board. For example, in the case when 20 LEDs are used, a 1000 to 2000 square millimeter heatsink contact area should be used. Using a larger heat sink 130 permits the LEDs 102 to be driven at higher power, and also allows for different heat sink designs, so that the cooling capacity is less dependent on the orientation of the heat sink. In addition, fans or other solutions for forced cooling may be used to remove the heat from the device. The bottom heat sink may include an aperture so that electrical connections can be made to the illumination module 100.

Figure 2A:
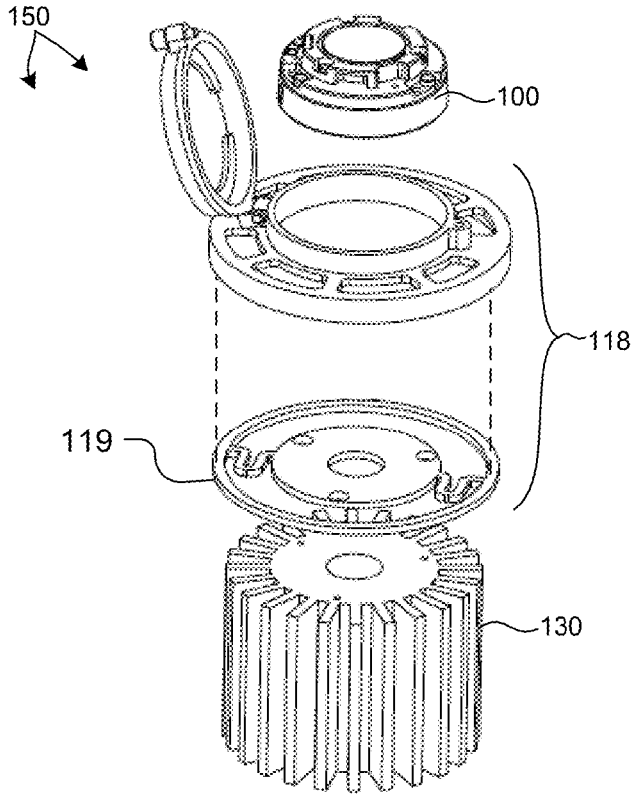
FIG. 2A shows an exploded, perspective view of an illumination device and a light fixture that includes an elastic mount.
Figure 2B:
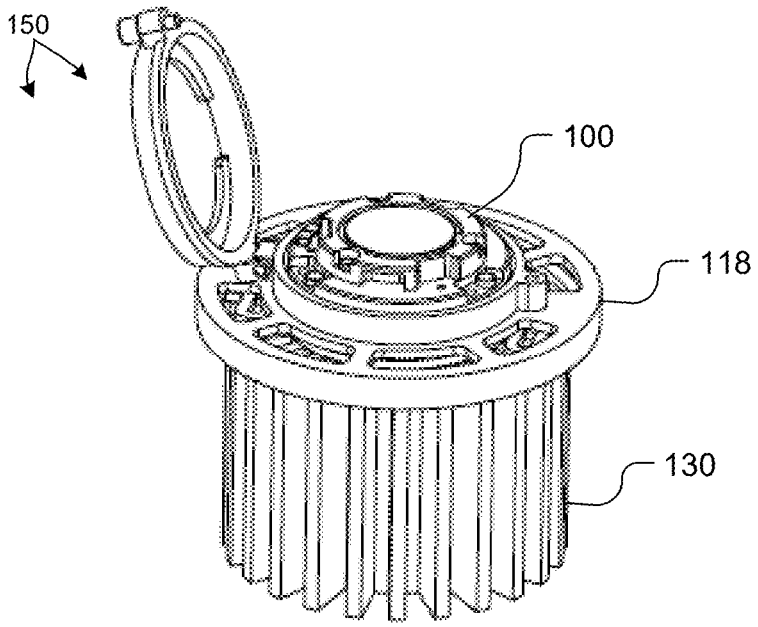
FIG. 2B illustrates the illumination module removably attached to the light fixture and pressed against elastic mount to which heat sink is coupled.

As discussed above, illumination module 100 is mounted to light fixture 130. As depicted in FIGS. 2A and 2B, luminaire 150 may include an illumination module 100 that is elastically mounted to light fixture 130. FIG. 2A shows an exploded, perspective view of an illumination module 100 and a light fixture 130 that includes an elastic mount 118. Elastic mount 118 is coupled to light fixture 130 (e.g. by weld, adhesives, rivet, or fastener). As depicted, heat sink 119 is coupled to elastic mount 118 by screw fasteners. As depicted in FIG. 2B, illumination module 100 is removably attached to light fixture 130 and pressed against elastic mount 118 to which heat sink 119 is coupled. In this manner heat may be conducted away from illumination module 100, through elastic mount 118 to heat sink 119. When illumination module 100 is mounted to light fixture 130, elastic mount 118 provides a restoring force that acts to press against the bottom surface of illumination module 100. To facilitate easy removal and replacement of illumination module 100, illumination module 100 may be removably coupled to light fixture 130 as discussed in this patent document, e.g., by means of a clamp mechanism, a twist-lock mechanism, or other appropriate arrangement.

Figure 3A:
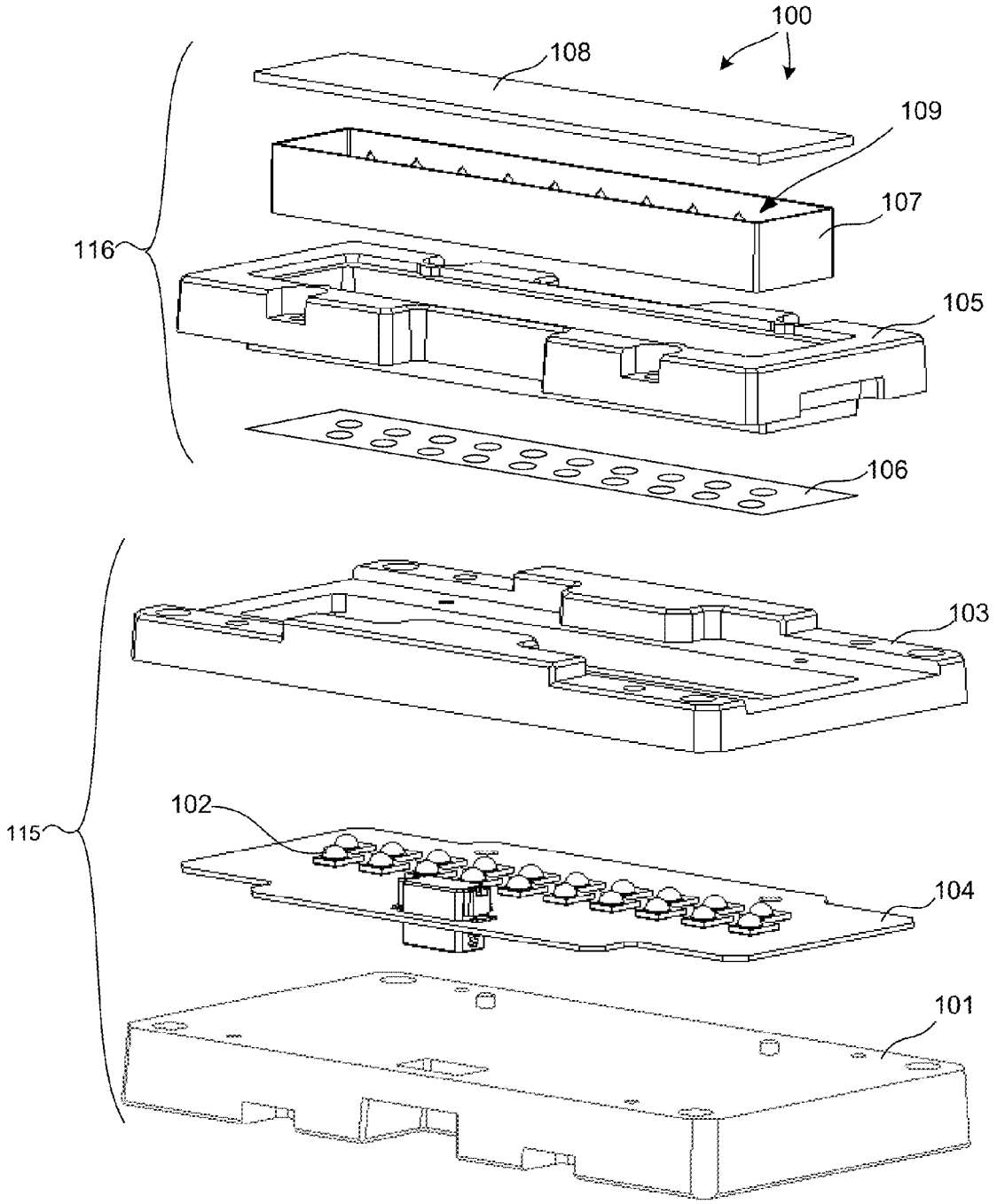
FIG. 3A shows an exploded view illustrating components of LED based illumination module as depicted in FIG. 1.
Figure 3B:
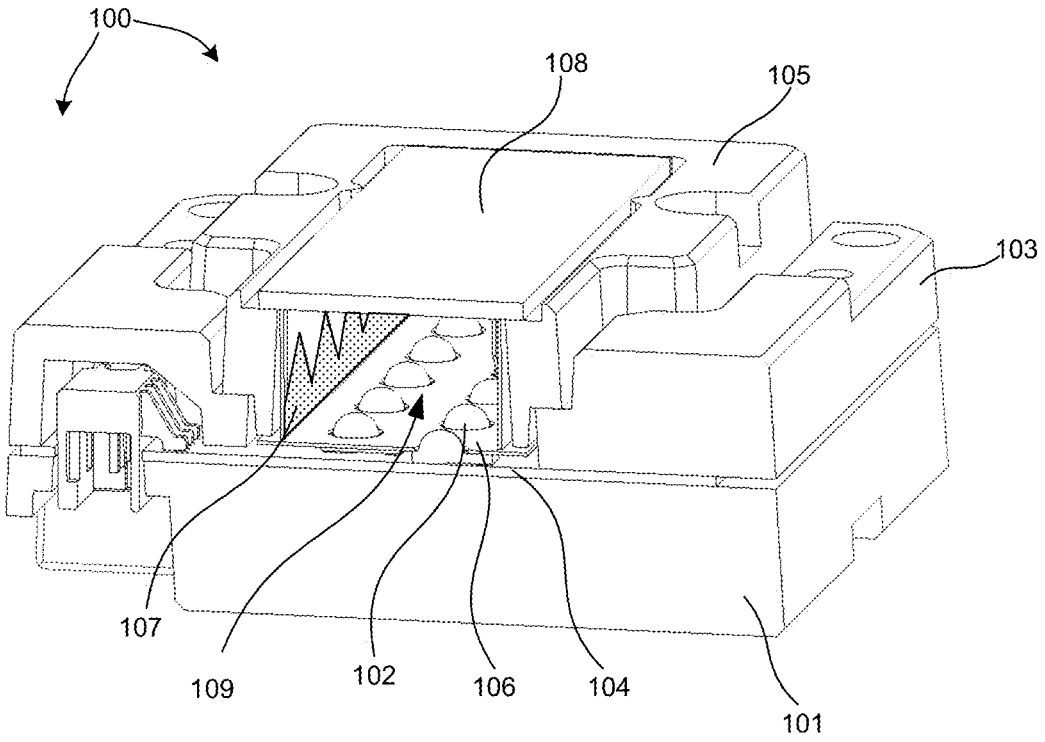
FIG. 3B illustrates a perspective, cross-sectional view of LED based illumination module as depicted in FIG. 1.

FIG. 3A shows an exploded view illustrating components of LED based illumination module 100 as depicted in FIG. 1. It should be understood that as defined herein an LED based illumination module is not an LED, but is an LED light source or fixture or component part of an LED light source or fixture. LED based illumination module 100 includes one or more LED die or packaged LEDs and a mounting board to which LED die or packaged LEDs are attached. FIG. 3B illustrates a perspective, cross-sectional view of LED based illumination module 100 as depicted in FIG. 1.

LED illumination device 100 includes one or more solid state light emitting elements, such as light emitting diodes (LEDs) 102, mounted on mounting board 104. Mounting board 104 is attached to mounting base 101 and secured in position by mounting board retaining ring 103. Together, mounting board 104 populated by LEDs 102 and mounting board retaining ring 103 comprise light source sub-assembly 115. Light source sub-assembly 115 is operable to convert electrical energy into light using LEDs 102. The light emitted from light source sub-assembly 115 is directed to light conversion sub-assembly 116 for color mixing and color conversion. Light conversion sub-assembly 116 includes cavity body 105 and output window 108, and optionally includes either or both bottom reflector insert 106 and sidewall insert 107. Output window 108 is fixed to the top of cavity body 105. Cavity body 105 includes interior sidewalls, which may be used to reflect light from the LEDS 102 until the light exits through output window 108 when sub-assembly 116 is mounted over light source sub-assembly 115. Bottom reflector insert 106 may optionally be placed over mounting board 104. Bottom reflector insert 106 includes holes such that the light emitting portion of each LED 102 is not blocked by bottom reflector insert 106. Sidewall insert 107 may optionally be placed inside cavity body 105 such that the interior surfaces of sidewall insert 107 reflect the light from the LEDS 102 until the light exits through output window 108 when sub-assembly 116 is mounted over light source sub-assembly 115.

In this embodiment, the sidewall insert 107, output window 108, and bottom reflector insert 106 disposed on mounting board 104 define a light mixing cavity 109 in the LED illumination device 100 in which a portion of light from the LEDs 102 is reflected until it exits through output window 108. Reflecting the light within the cavity 109 prior to exiting the output window 108 has the effect of mixing the light and providing a more uniform distribution of the light that is emitted from the LED illumination device 100. Portions of sidewall insert 107 may be coated with a wavelength converting material. Furthermore, portions of output window 108 may be coated with a different wavelength converting material. The photo converting properties of these materials in combination with the mixing of light within cavity 109 results in a color converted light output by output window 108. By tuning the chemical properties of the wavelength converting materials and the geometric properties of the coatings on the interior surfaces of cavity 109, specific color properties of light output by output window 108 may be specified, e.g. color point, color temperature, and color rendering index (CRI).

Cavity 109 may be filled with a non-solid material, such as air or an inert gas, so that the LEDs 102 emit light into the non-solid material. By way of example, the cavity may be hermetically sealed and Argon gas used to fill the cavity. Alternatively, Nitrogen may be used. In other embodiments, cavity 109 may be filled with a solid encapsulent material. By way of example, silicone may be used to fill the cavity.

The LEDs 102 can emit different or the same colors, either by direct emission or by phosphor conversion, e.g., where phosphor layers are applied to the LEDs as part of the LED package. Thus, the illumination module 100 may use any combination of colored LEDs 102, such as red, green, blue, amber, or cyan, or the LEDs 102 may all produce the same color light or may all produce white light. For example, the LEDs 102 may all emit either blue or UV light. When used in combination with phosphors (or other wavelength conversion means), which may be, e.g., in or on the output window 108, applied to the sidewalls of cavity body 105, or applied to other components placed inside the cavity (not shown), such that the output light of the illumination module 100 has the color as desired.

The mounting board 104 provides electrical connections to the attached LEDs 102 to a power supply (not shown). In one embodiment, the LEDs 102 are packaged LEDs, such as the Luxeon Rebel manufactured by Philips Lumileds Lighting. Other types of packaged LEDs may also be used, such as those manufactured by OSRAM (Ostar package), Luminus Devices (USA), Cree (USA), Nichia (Japan), or Tridonic (Austria). As defined herein, a packaged LED is an assembly of one or more LED die that contains electrical connections, such as wire bond connections or stud bumps, and possibly includes an optical element and thermal, mechanical, and electrical interfaces. The LEDs 102 may include a lens over the LED chips. Alternatively, LEDs without a lens may be used. LEDs without lenses may include protective layers, which may include phosphors. The phosphors can be applied as a dispersion in a binder, or applied as a separate plate. Each LED 102 includes at least one LED chip or die, which may be mounted on a submount. The LED chip typically has a size about 1 mm by 1 mm by 0.5 mm, but these dimensions may vary. In some embodiments, the LEDs 102 may include multiple chips. The multiple chips can emit light similar or different colors, e.g., red, green, and blue. The LEDs 102 may emit polarized light or non-polarized light and LED based illumination device 100 may use any combination of polarized or non-polarized LEDs. In some embodiments, LEDs 102 emit either blue or UV light because of the efficiency of LEDs emitting in these wavelength ranges. In addition, different phosphor layers may be applied on different chips on the same submount. The submount may be ceramic or other appropriate material. The submount typically includes electrical contact pads on a bottom surface that are coupled to contacts on the mounting board 104. Alternatively, electrical bond wires may be used to electrically connect the chips to a mounting board. Along with electrical contact pads, the LEDs 102 may include thermal contact areas on the bottom surface of the submount through which heat generated by the LED chips can be extracted. The thermal contact areas are coupled to heat spreading layers on the mounting board 104. Heat spreading layers may be disposed on any of the top, bottom, or intermediate layers of mounting board 104. Heat spreading layers may be connected by vias that connect any of the top, bottom, and intermediate heat spreading layers.

In some embodiments, the mounting board 104 conducts heat generated by the LEDs 102 to the sides of the board 104 and the bottom of the board 104. In one example, the bottom of mounting board 104 may be thermally coupled to a heat sink 130 (shown in FIGS. 1 and 2) via mounting base 101. In other examples, mounting board 104 may be directly coupled to a heat sink, or a lighting fixture and/or other mechanisms to dissipate the heat, such as a fan. In some embodiments, the mounting board 104 conducts heat to a heat sink thermally coupled to the top of the board 104. For example, mounting board retaining ring 103 and cavity body 105 may conduct heat away from the top surface of mounting board 104. Mounting board 104 may be an FR4 board, e.g., that is 0.5 mm thick, with relatively thick copper layers, e.g., 30 μm to 100 μm, on the top and bottom surfaces that serve as thermal contact areas. In other examples, the board 104 may be a metal core printed circuit board (PCB) or a ceramic submount with appropriate electrical connections. Other types of boards may be used, such as those made of alumina (aluminum oxide in ceramic form), or aluminum nitride (also in ceramic form).

Mounting board 104 includes electrical pads to which the electrical pads on the LEDs 102 are connected. The electrical pads are electrically connected by a metal, e.g., copper, trace to a contact, to which a wire, bridge or other external electrical source is connected. In some embodiments, the electrical pads may be vias through the board 104 and the electrical connection is made on the opposite side, i.e., the bottom, of the board. Mounting board 104, as illustrated, is rectangular in dimension. LEDs 102 mounted to mounting board 104 may be arranged in different configurations on rectangular mounting board 104. In one example LEDs 102 are aligned in rows extending in the length dimension and in columns extending in the width dimension of mounting board 104. In another example, LEDs 102 are arranged in a hexagonally closely packed structure. In such an arrangement each LED is equidistant from each of its immediate neighbors. Such an arrangement is desirable to increase the uniformity of light emitted from the light source sub-assembly 115.

Figure 4:
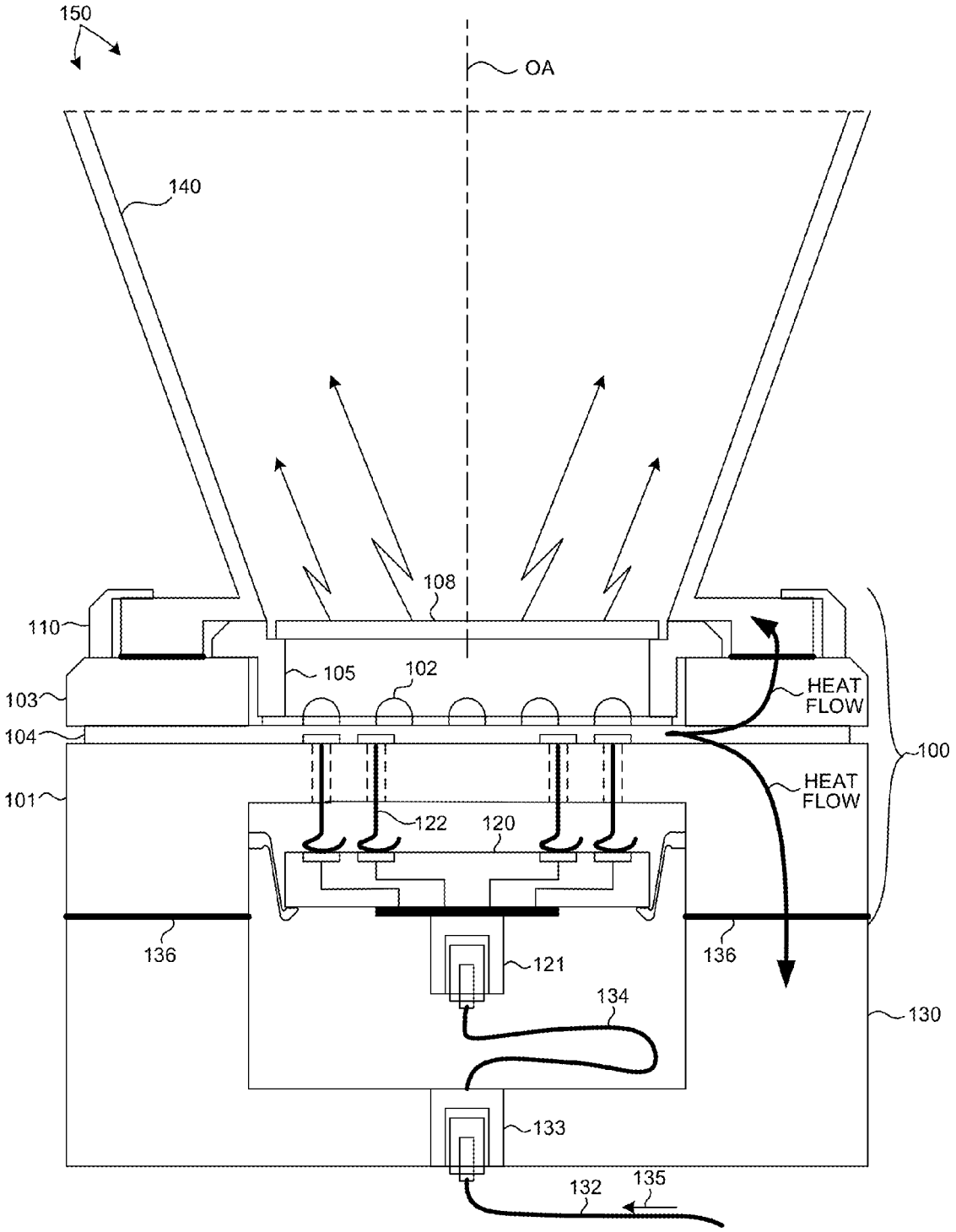
FIG. 4 illustrates a cut-away view of luminaire as depicted in FIG. 1B.

FIG. 4 illustrates a cut-away view of luminaire 150 as depicted in FIG. 1B. Reflector 140 is removably coupled to illumination module 100. Reflector 140 is coupled to module 100 by a twist-lock mechanism. Reflector 140 is aligned with module 100 by bringing reflector 140 into contact with module 100 through openings in reflector retaining ring 110. Reflector 140 is coupled to module 100 by rotating reflector 140 about optical axis (OA) to an engaged position. In the engaged position, the reflector 140 is captured between mounting board retaining ring 103 and reflector retaining ring 110. In the engaged position, an interface pressure may be generated between mating thermal interface surfaces of reflector 140 and mounting board retaining ring 103. In this manner, heat generated by LEDs 102 may be conducted via mounting board 104, through mounting board retaining ring 103 and into reflector 140.

In some embodiments, illumination module 100 includes an electrical interface module (EIM) 120. The EIM 120 communicates electrical signals from light fixture 130 to illumination module 100. In the illustrated example, light fixture 130 acts as a heat sink. Electrical conductors 132 are coupled to light fixture 130 at electrical connector 133. By way of example, electrical connector 133 may be a registered jack (RJ) connector commonly used in network communications applications. In other examples, electrical conductors 132 may be coupled to light fixture 130 by screws or clamps. In other examples, electrical conductors 132 may be coupled to light fixture 130 by a removable slip-fit electrical connector. Connector 133 is coupled to conductors 134. Conductors 134 are removably coupled to electrical connector 121 mounted to EIM 120. Similarly, electrical connector 121 may be a RJ connector or any suitable removable electrical connector. Connector 121 is fixedly coupled to EIM 120. Electrical signals 135 are communicated over conductors 132 through electrical connector 133, over conductors 134, through electrical connector 121 to EIM 120. EIM 120 routes electrical signals 135 from electrical connector 121 to appropriate electrical contact pads on EIM 120. Electrical signals 135 may include power signals and data signals. In the illustrated example, spring pins 122 couple contact pads of EIM 120 to contact pads of mounting board 104. In this manner, electrical signals are communicated from EIM 120 to mounting board 104. Mounting board 104 includes conductors to appropriately couple LEDs 102 to the contact pads of mounting board 104. In this manner, electrical signals are communicated from mounting board 104 to appropriate LEDs 102 to generate light.

Mounting base 101 is replaceably coupled to light fixture 130. Mounting base 101 and light fixture 130 are coupled together at a thermal interface 136. At the thermal interface, a portion of mounting base 101 and a portion of light fixture 130 are brought into contact as illumination module 100 is coupled to light fixture 130. In this manner, heat generated by LEDs 102 may be conducted via mounting board 104, through mounting base 101 and into light fixture 130.

To remove and replace illumination module 100, illumination module 100 is decoupled from light fixture 130 and electrical connector 121 is disconnected. In one example, conductors 134 includes sufficient length to allow sufficient separation between illumination module 100 and light fixture 130 to allow an operator to reach between fixture 130 and module 100 to disconnect connector 121. In another example, connector 121 may be arranged such that a displacement between illumination module 100 from light fixture 130 operates to disconnect connector 121.

Figure 5:
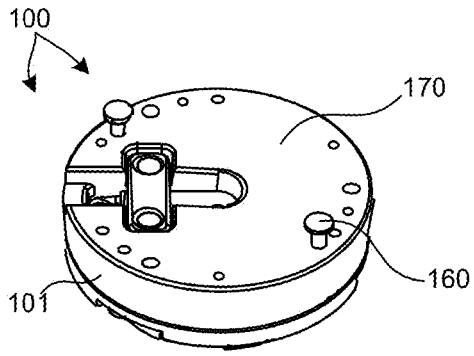
FIGS. 5-10C illustrate a first embodiment suited for convenient removal and installation of an LED based illumination module to a light fixture.
Figure 6:
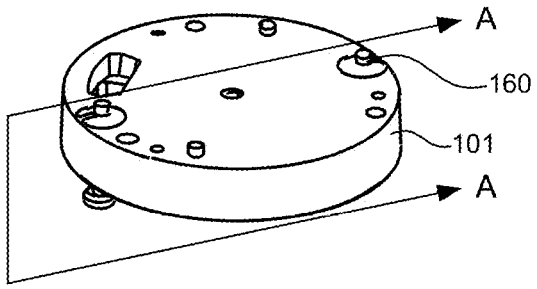
Figure 7:
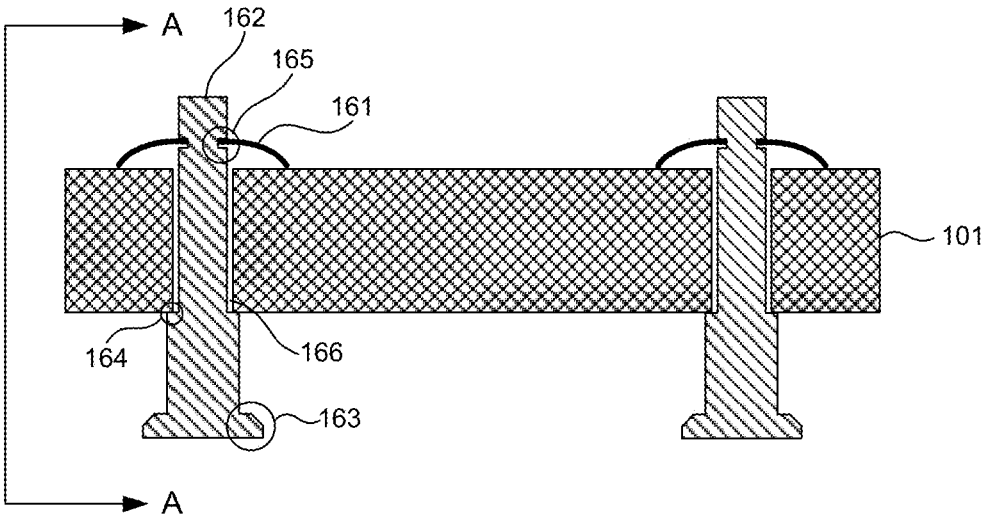

FIGS. 5-10C illustrate a first embodiment suited for convenient removal and installation of an LED based illumination module to a light fixture 130. FIG. 5 illustrates a perspective view of the bottom side of illumination module 100. In the illustrated embodiment, illumination module 100 includes two spring pin assemblies 160 positioned opposite one another near the perimeter of module 100. In another embodiment, additional spring pin assemblies may be employed and positioned equidistant from one another near the perimeter of module 100. In other embodiments, the spring pin assemblies may not be positioned equidistant from one another. This may be desirable to create a mechanism that allows only one orientation between module 100 and heat sink 130 when module 100 is coupled to heat sink 130. FIG. 6 illustrates a perspective view of the top side of mounting base 101 of module 100 with spring pins 160 installed. A section indicator A is illustrated in FIG. 6. FIG. 7 illustrates cross-section A of FIG. 6. A spring pin assembly 160 includes a spring 161 and a pin 162. In the illustrated embodiment, pin 161 includes a tapered head 163, a shoulder 164, and a radial groove 161. In the illustrated embodiment, spring 161 is a cup shaped c-clip. In other embodiments, other spring mechanisms may be employed (e.g. coil spring and e-clip). Pin 162 loosely fits through a hole 166 provided in mounting base 101. The diameter of shoulder 164 is greater than the diameter of hole 166, thus pin 162 may only extend through mounting base 101 to the position where shoulder 164 contacts the bottom surface of mounting base 101. At this position, spring 161 is inserted into radial groove 165 of pin 162. In this manner, spring 161 acts to retain pin 162 within hole 166. Spring 161 also provides a restoring force acting in the direction of pin insertion into hole 166 in response to a displacement of pin 162 in a direction opposite the direction of pin insertion.

Figure 8:
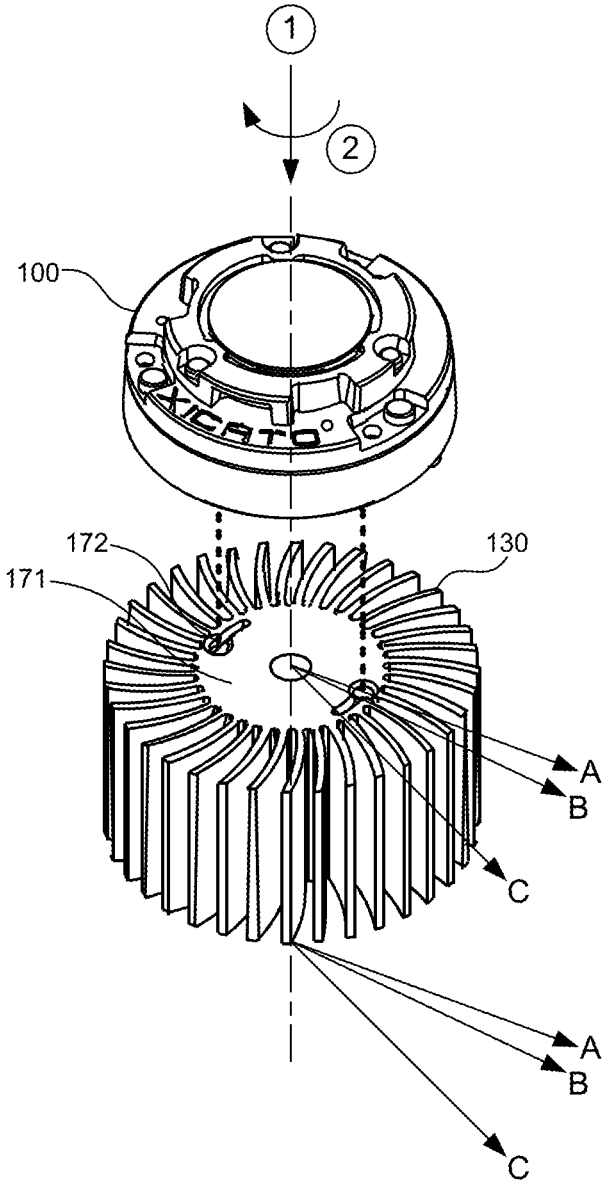
Figure 9:
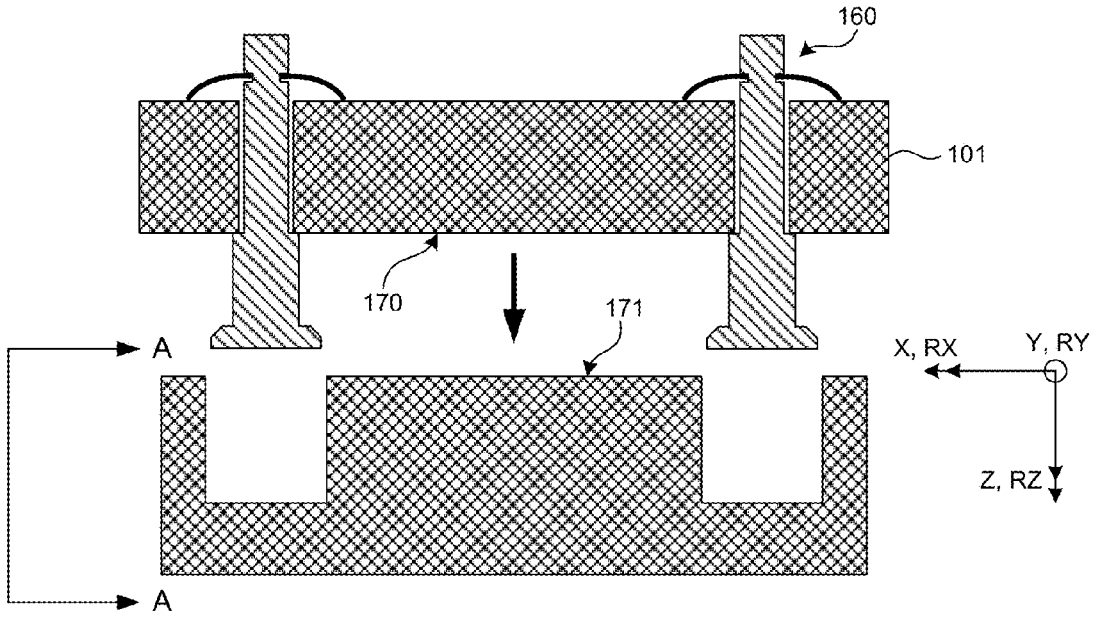
Figure 10A:
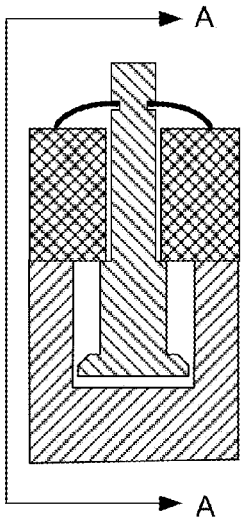
Figure 10B:
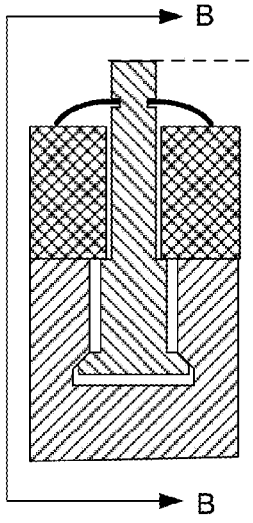
Figure 10C:
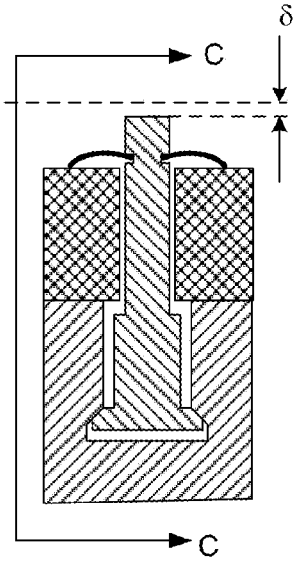

FIG. 8 illustrates the steps of aligning and replaceably coupling illumination module 100 with heat sink 130 in accordance with the first embodiment. Heat sink 130 includes thermal interface surface 171 on the top face of heat sink 130. Illumination module 100 includes thermal interface surface 170 (see FIG. 5). In the illustrated example, heat sink 130 also includes radially cut ramped shoulder grooves 172. Shoulder grooves 172 are positioned on the face of heat sink to correspond with the position of spring pins 160. In a first step, illumination module 100 is aligned with heat sink 130. As illustrated in FIG. 9, spring pins 160 are aligned with shoulder grooves 172 in the horizontal dimensions x and y and in the rotational dimensions Rx, Ry, and Rz, then module 100 is translated in the z dimension until the interface surfaces 170 and 171 come into contact. After alignment, in a second step, module 100 is rotated with respect to heat sink 130 to couple module 100 to heat sink 130 as illustrated in FIG. 8. Three section indicators, A, B, and C, are illustrated in FIG. 8. Section A, illustrated in FIG. 10A, depicts the alignment of module 100 and heat sink 130. In the aligned position, spring pin 160 loosely sits within a blind hole portion of ramped shoulder groove 172. In this position, shoulder 164 of pin 162 remains in contact with base 101. Section B, illustrated in FIG. 10B, is a view of module 100 rotated with respect to Section A and illustrates the start of engagement of the spring pin 160 and the ramped shoulder groove 172. In this position, spring pin 160 contacts a tapered portion of groove 172. As illustrated the tapered head of pin 160 makes contact with the corresponding taper of groove 172. Section C, illustrated in FIG. 10C, is a view of module 100 rotated to a fully engaged position where module 100 is coupled to heat sink 130. In this position, spring pin 162 is displaced by an amount, Δ, in the z direction with respect to base 101. Shoulder 164 moves off of base 101. As a result of this displacement, spring 161 deforms and generates a restoring force in the direction opposite the displacement of pin 162. This restoring force acts to generate a compressive force between thermal interface surface 170 of module 100 and thermal interface surface 171 of heat sink 130. Groove 172 ramps downward from the face of heat sink 130 as it is radially cut from the initial aligned position to the engaged position. As a result, pin 162 is displaced in the z-direction as module 100 is rotated from the aligned position to the engaged position.

Figure 11A:
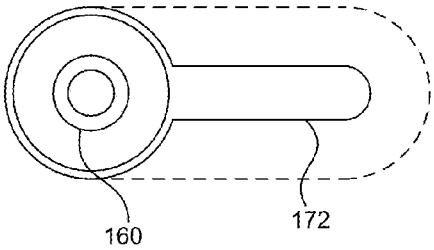
FIGS. 11A-12C are illustrative an alternative of the first embodiment for convenient removal and installation of an LED based illumination module to a light fixture.
Figure 11C:
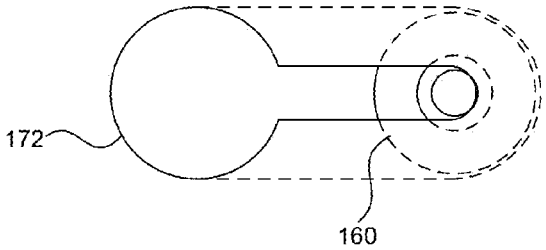
Figure 11B:
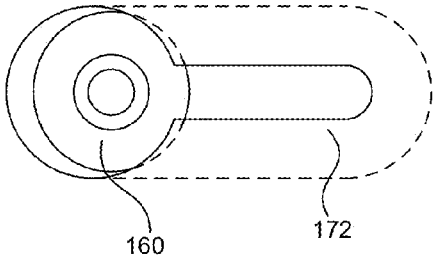
Figure 12A:
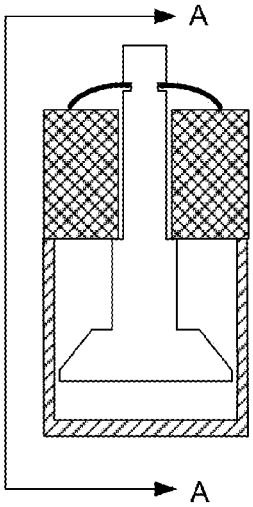
Figure 12B:
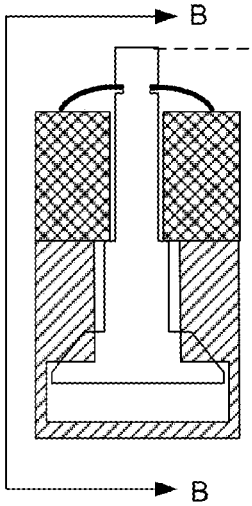
Figure 12C:
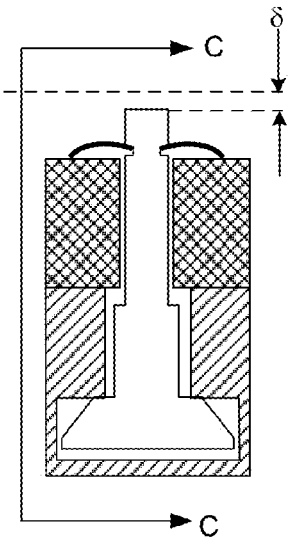

In another embodiment, heat sink 130 includes radially cut shoulder grooves 172 that are not ramped. FIGS. 11A-12C are illustrative of this embodiment. FIG. 11A illustrates a top view of spring pin 160 aligned with shoulder groove 172. Section A of FIG. 8 is illustrated in FIG. 12A. FIG. 12A depicts the alignment of module 100 and heat sink 130. In the aligned position, spring pin 160 loosely sits within a blind hole portion of shoulder groove 172. FIG. 11B illustrates a top view of spring pin 160 engaging shoulder groove 172. Section B of FIG. 8 is illustrated in FIG. 12B. In this view, module 100 is rotated with respect to Section A and illustrates the start of engagement of the spring pin 160 and the shoulder groove 172. In this position, the tapered surface of spring pin 160 contacts shoulder groove 172. As illustrated the tapered head of pin 160 makes contact with groove 172. FIG. 11C illustrates a top view of spring pin 160 engaged in shoulder groove 172. Section C of FIG. 8 is illustrated in FIG. 12C. In this view module 100 is rotated to a fully engaged position where module 100 is coupled to heat sink 130. In this position, spring pin 162 is displaced by an amount, Δ, in the z direction with respect to base 101. Shoulder 164 moves off of base 101. As a result of this displacement, spring 161 deforms and generates a restoring force in the direction opposite the displacement of pin 162. This restoring force acts to generate a compressive force between thermal interface surface 170 of module 100 and thermal interface surface 171 of heat sink 130. Groove 172 remains at the same distance from the face of heat sink 130 as it is radially cut from the initial aligned position to the engaged position. Pin 162 is displaced in the z-direction as module 100 is rotated from the aligned position to the engaged position by sliding between the tapered surface of pin 162 along shoulder groove 172.

Figure 13A:
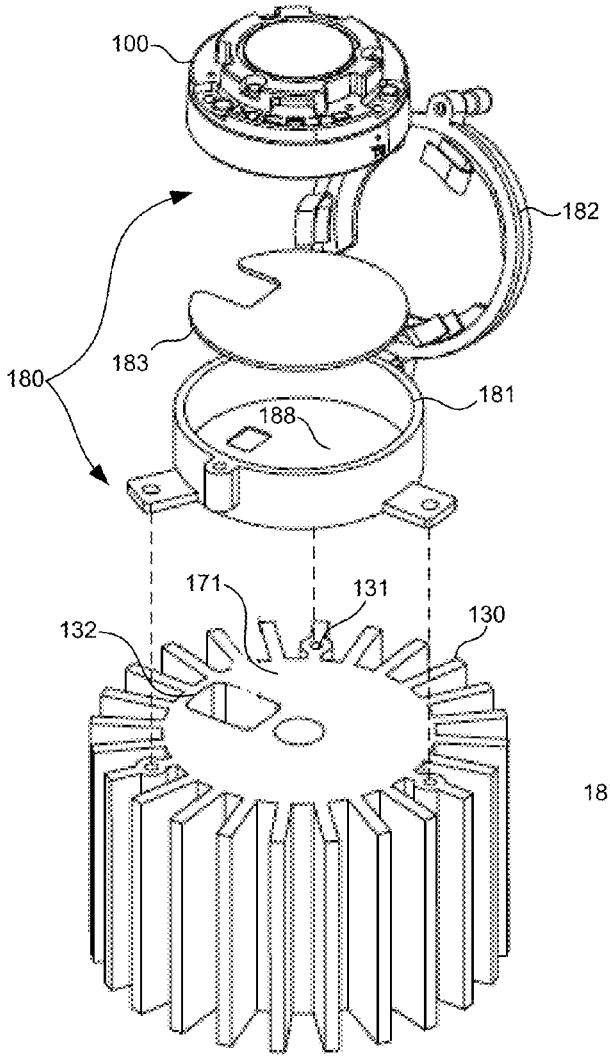
FIGS. 13A-13B illustrate a second embodiment suited for convenient removal and installation of an LED based illumination module in a luminaire.
Figure 13B:
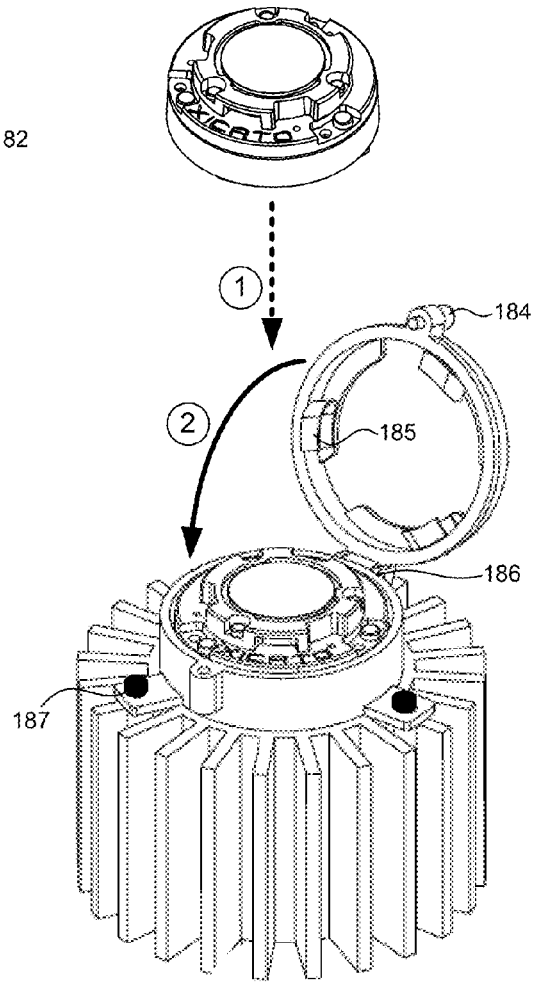

FIGS. 13A-13B illustrate a second embodiment suited for convenient removal and installation of an LED based illumination module in a luminaire. FIG. 13A illustrates a perspective, exploded view of illumination module 100, mounting collar assembly 180, and heat sink 130. Mounting collar assembly 180 includes a base member 181 and a retaining member 182. Base member 181 and retaining member 182 are coupled by hinge element 186. In this arrangement, retaining member 182 is operable to rotate about the axis of rotation of hinge 186 and move with respect to base member 181. Base member 181 is coupled to heat sink 130 by suitable fastening means. In the illustrated example, base member 181 is coupled to heat sink 130 by screws 187 threaded into threaded holes 131 of heat sink 130. In other examples, base member 181 may be coupled to heat sink 130 by adhesives or by a weld, or any combination of screws, weld, or adhesives. In the illustrated example, illumination module 100 is placed within base member 181. In this manner module 100 is aligned with mounting collar assembly 180. As depicted, the bottom surface of base member 181 contacts heat sink 130 over thermal interface surface 171 of heat sink 130. A pliable, thermally conductive pad or thermally conductive paste may be employed between surface 171 and the bottom surface of base member 181 to enhance the thermal conductivity at their interface. In the illustrated embodiment, base member 181 includes bottom member 188, however, in other embodiments, base member 183 may not employ member 188. In these embodiments the thermal interface surface 170 (see FIG. 5) of illumination module 100 contacts corresponding thermal interface surface 171 of heat sink 130. As discussed above, depending on the manufacturing conditions and thermal requirements, a pliable, thermally conductive pad or thermally conductive paste may be employed between the two surfaces to enhance thermal conductivity.

FIG. 13B illustrates illumination module 100 replaceably coupled to heat sink 130. In a first step, module 100 is place within base element 181 of mounting collar assembly 180. In a second step, retaining member 182 is rotated with respect to base element 181 to capture module 100 within mounting collar assembly 180. Retaining member 182 includes elastic mounting members 185. As retaining member 182 is rotating closed, elastic mounting members 185 make contact with illumination module 100. Elastic mounting members 185 are configured such that contact is made with module 100 before retaining member 182 reaches a fully closed position. As a result, after initial contact with module 100, elastic mounting members 185 deform until retaining member 182 reaches the fully closed position. In the illustrated example, a threaded screw 184 is employed to couple retaining member 182 to base member 181. In some embodiments, threaded screw 184 includes a knurled surface operable by human hands to drive and retain retaining member 182 with respect to base member 181 in the closed position. In other embodiments, a buckle, clip, or other fixing means may be employed to drive and retain retaining member 182 with respect to base member 181 in the closed position. By deforming elastic mounting members 185 as retaining member 182 rotates to the fully closed position, members 185 generate a force acting to press module 100 against heat sink 130.

FIGS. 14A-15B illustrate a third embodiment suited for convenient removal and installation of an LED based illumination module in a luminaire. As illustrated in FIG. 14A, a mounting collar 190 is attached to heat sink 130. Mounting collar 190 includes module engaging members 192 to align and retain module 100 in an engaged position. Mounting collar 190 is coupled to heat sink 130 by suitable fastening means. In the illustrated example, collar 190 is coupled to heat sink 130 by screws 193 threaded into threaded holes 131 of heat sink 130. In other examples, collar 190 may be coupled to heat sink 130 by adhesives or by a weld, or any combination of screws, weld, or adhesives. As illustrated in FIG. 14A, illumination module 100 includes elastic mounting members 191. As depicted, elastic mounting members 191 are radially extending structures that are contiguous with module 100. As contiguous parts of module 100, members 191 are manufactured together with module 100 as one contiguous part. Members 191 may be configured to extend radially along the perimeter of illumination module 100 as depicted. For example, three members may be employed equidistant along the perimeter of module 100. In other embodiments, less or more members may be employed. In other embodiments, members 191 may not be placed equidistant from one another. In these configurations, the lack of symmetry of the elements may be used as an indexing feature to align module 100 in a particular orientation with respect to heat sink 130. Module engaging members 192 are oriented such that openings are available in mounting collar 190 that correspond with the elastic mounting members 191 of module 100. In some embodiments, module engaging members 192 are ramped such that a rotation of module 100 with respect to collar 190 causes a relative displacement of module 100 with respect to collar 190 when module engaging members 192 are in contact with elastic mounting members 191. In other embodiments, elastic mounting members 191 are ramped such that a rotation of module 100 with respect to collar 190 causes a relative displacement of module 100 with respect to collar 190 when module engaging members 192 are in contact with elastic mounting members 191.

FIG. 14B illustrates steps of aligning and engaging module 100 with mounting collar 190. In a first step, module 100 is placed within mounting collar 190. Openings that separate module engaging members 192 of collar 190 are configured such that elastic mounting members may pass through the openings at the appropriate orientation of module 100 with respect to collar 190. In a second step, module 100 is rotated with respect to collar 190. In some embodiments, module 100 may be rotated by human hands. In other embodiments, module 100 includes a tool feature 195. In these embodiments a complementary tool (e.g. socket and lever) may be employed to engage with the tool feature 195 of module 100 to facilitate assembly and increase the torque that may be applied to module 100. As module 100 is rotated with respect to collar 190, the contact between the elastic mounting members 191 and the module engaging members 192 causes a displacement between module 100 and collar 190 until module 100 contacts heat sink 130 across thermal interface surface 171. Further rotation causes elastic mounting members 191 to deform until a fully engaged position is reached.

FIG. 15A illustrates a cut-away view of module 100 in the aligned position. In this position, elastic mounting members 191 are undeformed. In contrast FIG. 15B illustrates a cut-away view of module 100 in the fully engaged position. In this position, elastic mounting members 191 are deformed by an amount, Δ, due to the rotation of module 100 with respect to ramped module engaging members 192. By deforming elastic mounting members 191, a force is generated that acts to press module 100 against heat sink 130.

Figure 16:
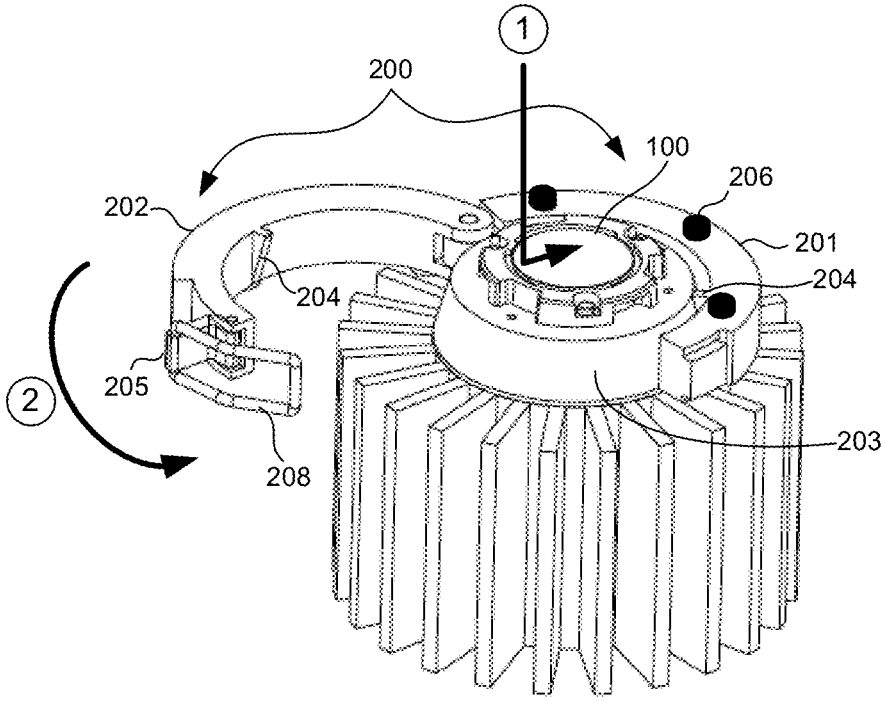
FIGS. 16-17 illustrate a fourth embodiment suited for convenient removal and installation of an LED based illumination module in a luminaire.
Figure 17:
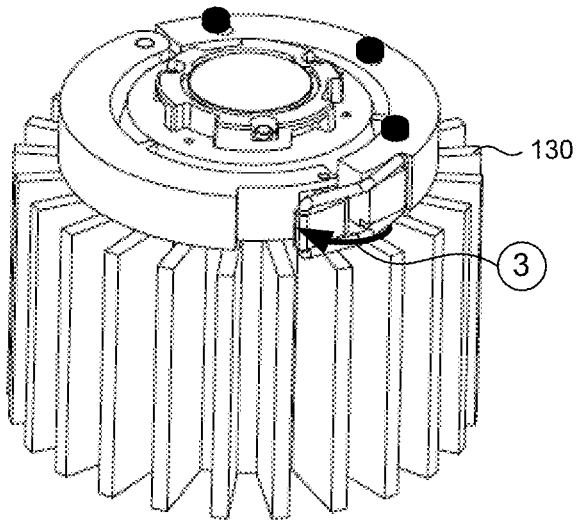

FIGS. 16-17 illustrate a fourth embodiment suited for convenient removal and installation of an LED based illumination module in a luminaire. FIG. 16 illustrates a perspective view of illumination module 100, mounting collar assembly 200, and heat sink 130. Illumination module 100 includes a tapered surface 203 positioned at the perimeter of module 100. As depicted in FIG. 16, surface 203 tapers toward the center of module 100 from the bottom to the top of module 100. Also, as depicted in FIG. 16, surface 203 is a continuous surface over the entire perimeter of module 100. In other embodiments, surface 203 may be positioned at several discrete locations at the perimeter of module 100, rather than encompassing the entire perimeter of module 100. Mounting collar assembly 200 includes a fixed retaining member 201 and a movable retaining member 202. Fixed retaining member 201 and movable retaining member 202 are coupled by hinge element 207 with an axis of rotation in a direction normal to the output window 108 of module 100. In this arrangement, movable retaining member 202 is operable to rotate about the axis of rotation with respect to fixed retaining member 201. Fixed retaining member 201 is coupled to heat sink 130 by suitable fastening means. In the illustrated example, fixed retaining member 201 is coupled to heat sink 130 by screws 206 threaded into threaded holes of heat sink 130. In other examples, fixed retaining member 201 may be coupled to heat sink 130 by adhesives or by a weld, or any combination of screws, weld, and adhesives. Fixed retaining member 201 and movable retaining member 202 include tapered elements 204. The tapered surface of elements 204 matches the taper of tapered surface 203.

FIGS. 16 and 17 illustrate illumination module 100 replaceably coupled to heat sink 130. In a first step, module 100 is place within fixed retaining element 201 of mounting collar assembly 200. In a second step, movable retaining member 202 is rotated with respect to fixed retaining element 201 to capture module 100 within mounting collar assembly 200. As movable retaining member 202 is rotating closed, tapered elements 204 make contact with illumination module 100 and capture module 100 within assembly 200 and heat sink 130. In an aligned position, the bottom surface of module 100 is in contact with heat sink 130 and tapered elements 204 of assembly 200 are in contact with module 100. In a third step, buckle 205 of moveable retaining member 202 is coupled to fixed retaining element 201 and moved to a closed position. Buckle 205 includes an elastic element 208. As buckle 205 is moved to the closed position, elastic element 208 deforms and a clamping force is generated that acts in the direction of closure between the fixed and movable retaining elements. The clamping force acting in the direction of closure generates a force to press module 100 against heat sink 130. The interaction between tapered elements 204 and tapered surface 203 of module 100 causes a portion of the clamping force to be redirected to the direction normal to the bottom surface of module 100. In this manner, deforming elastic element 208 as movable retaining member 202 rotates to the fully closed position generates a force acting to press module 100 against heat sink 130.

In the illustrated example, a buckle 205 is employed to couple movable retaining member 202 to fixed retaining member 201. In some embodiments, buckle 205 may be mounted to fixed retaining member 201 rather than member 202. In other embodiments, a screw, clip, or other fixing means may be employed to drive and retain movable retaining member 202 with respect to fixed retaining member 201 in the closed position.

Figure 18:
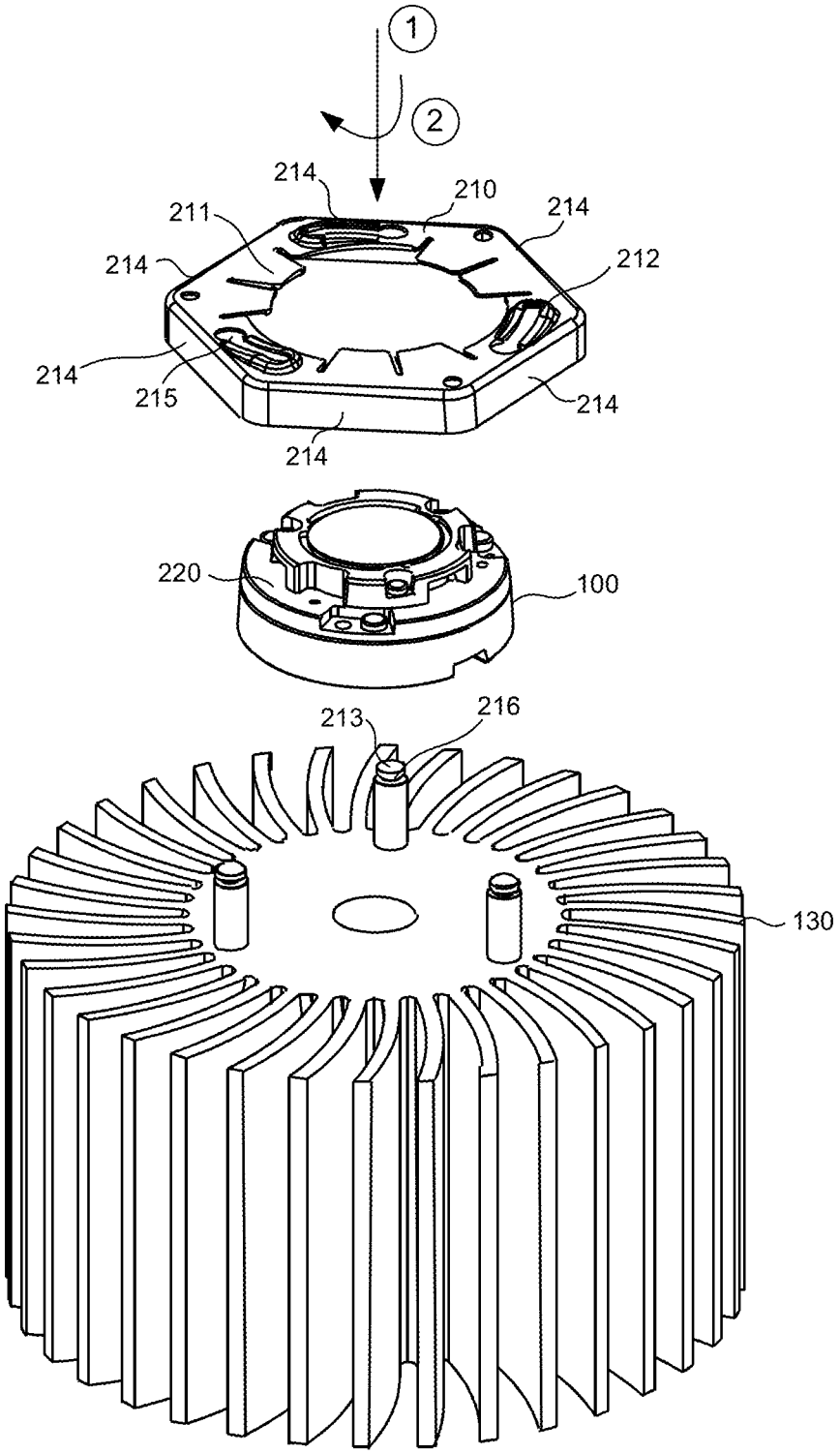
FIGS. 18-21B illustrate a fifth embodiment suited for convenient removal and installation of an LED based illumination module in a luminaire.

FIGS. 18-21B illustrate a fifth embodiment suited for convenient removal and installation of an LED based illumination module in a luminaire. FIG. 18 illustrates a perspective view of illumination module 100, mounting collar 210, and heat sink 130. Heat sink 130 includes a plurality of pins 213. In the illustrated embodiment each pin 213 includes a groove 216 configured to engage with ramp feature 212 of mounting collar 210. In other embodiments pin 213 may include a head configured to engage with ramp feature 212. Each pin 213 is fixedly attached to heat sink 130 (e.g. press fit, threaded, fixed by adhesive). Alternatively each pin 213 may be cast or machined as part of heat sink 130. Pins 213 are arranged outside the perimeter of illumination module 100 such that module 100 may be placed between pins 213 such that the bottom surface of module 100 comes into contact with the top surface of heat sink 130. Alternatively in some embodiments, some or all of pins 213 may be arranged within or along the perimeter of illumination module 100. In these embodiments, module 100 includes through holes such that pins 213 may pass through the holes until the bottom surface of module 100 comes into contact with the top surface of heat sink 130. As illustrated, pins 213 are arranged equidistant from one another and are spaced such that illumination module 100 fits loosely between the pins. In other embodiments, pins 213 may not be arranged equidistant from one another. In these configurations, the lack of symmetry of the elements may be used as an indexing feature to align module 100 in a particular orientation with respect to heat sink 130. Mounting collar 210 includes elastic members 211. In the illustrated embodiment, elastic members 211 are included as an integral part of mounting collar 210. For example, collar 210 may be a formed sheet metal part including elastic members 211 as part of the single formed sheet metal part. In other examples, elastic members 211 may be cast or molded as part of a single part mounting collar 210. Mounting collar 210 may optionally include tool feature 214. As illustrated tool feature 214 includes a plurality of surfaces of mounting collar 210. In the illustrated embodiment a complementary tool (e.g. socket and lever) may be employed to engage with the tool feature 214 of collar 210 to facilitate assembly and increase the torque that may be applied to collar 210. As depicted in FIG. 18, mounting collar 210 includes ramp features 212. In the illustrated example, ramp features 212 are formed into collar 210 (e.g. by stamping, molding, or casting). In other embodiments, ramp features 212 may be affixed to collar 210 (e.g. by soldering, welding, or adhesives).

In a first step, module 100 is captured by mounting collar 210 and aligned with heat sink 130. As illustrated, module 100 is placed within pins 213 and mounting collar 210 is placed over module 100. Mounting collar 210 includes through holes 215 at the beginning of each ramp feature 212. In the aligned configuration, mounting collar 210 is placed over module 100 such that pins 213 pass through the through holes 215 of mounting collar 210. In a second step, mounting collar 210 is rotated with respect to heat sink 130 to a fully engaged position. As discussed above, collar 210 may be rotated directly by human hands, or alternatively with the assistance of a tool acting on tool feature 214 to increase the torque applied to mounting collar 210. As collar 210 is rotated, the grooves 216 of pins 213 engage with ramp feature 212 and elastic elements 211 engage with surface 220 of module 100. Surface 220 is illustrated for exemplary purposes, however, any surface of module 100 may used to engage with elastic elements 211. Once engaged, the rotation of collar 210 causes collar 210 to displace toward heat sink 130. Furthermore, as a result of the displacement, elastic elements 211 deform and generate a compressive force between module 100 and heat sink 130 that acts to press module 100 against heat sink 130.

Figure 19A:
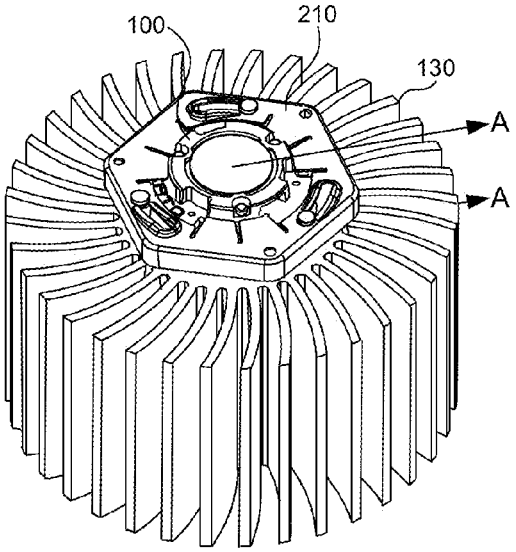
Figure 19B:
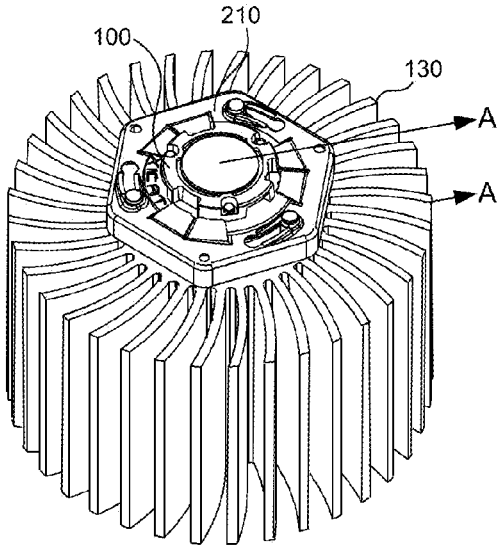
Figure 20A:
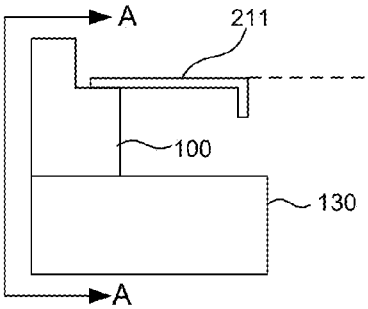
Figure 20B:
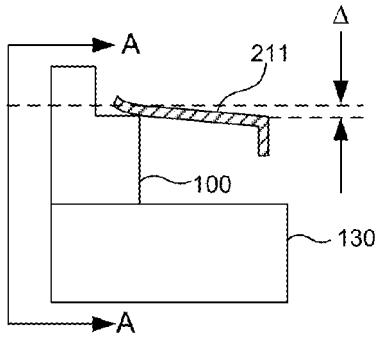
Figure 21A:
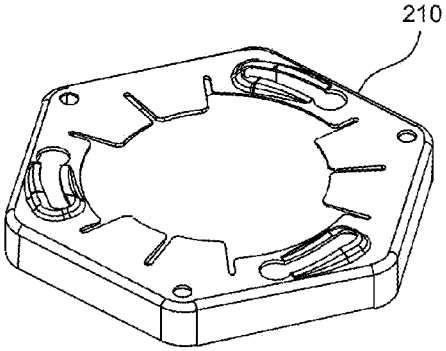
Figure 21B:
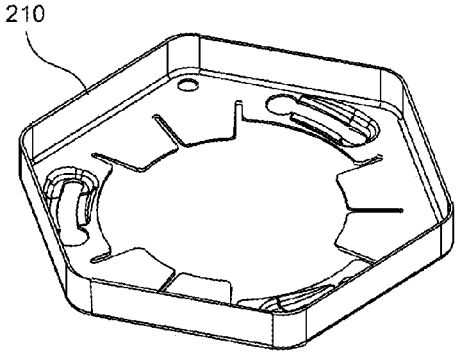

FIG. 19A illustrates mounting collar 210, module 100, and heat sink 130 in the aligned position. FIG. 20A illustrates cross sectional view A of FIG. 19A. In the aligned position, elastic elements 211 are in contact module 100, but are not deformed. FIG. 19B illustrates mounting collar 210, module 100, and heat sink 130 in the fully engaged position after rotation of collar 210 with respect to heat sink 130. FIG. 20B illustrates cross sectional view A of FIG. 19B. In the fully engaged position, elastic elements 211 are in contact module 100 and are deformed. As discussed above, the deformation generates a force acting to press module 100 and heat sink 130 together. FIG. 21A illustrates a top, perspective view of mounting collar 210 and FIG. 21B illustrates a bottom, perspective view of collar 210. As discussed above, ramp feature 212 is optional. In some embodiments, feature 212 is not a ramp feature, but is simply a slot feature. The slot feature includes the cut-out portion of feature 212, but remains in plane with the top surface of collar 210, rather than rising above the top surface as ramp feature 212 is depicted. In these embodiments, in a first step, mounting collar 210 is placed over module 100 such that pins 213 pass through holes 215 of collar 210 as discussed above. However, after elastic elements 211 come into contact with module 100, a force is applied to collar 210 in a direction normal to the bottom surface of module 100 that causes elements 211 to deform and generate a force to press module 100 and heat sink 130 together. In these embodiments, an aligned position is reached when the grooves 216 of pins 213 align in the normal direction with slot feature 212. In a second step, collar 210 is rotated with respect to heat sink 130 to a locked position. In these embodiments, grooves 216 slide within slot feature 212 and act to lock collar 210 to heat sink 130.

Figure 22:
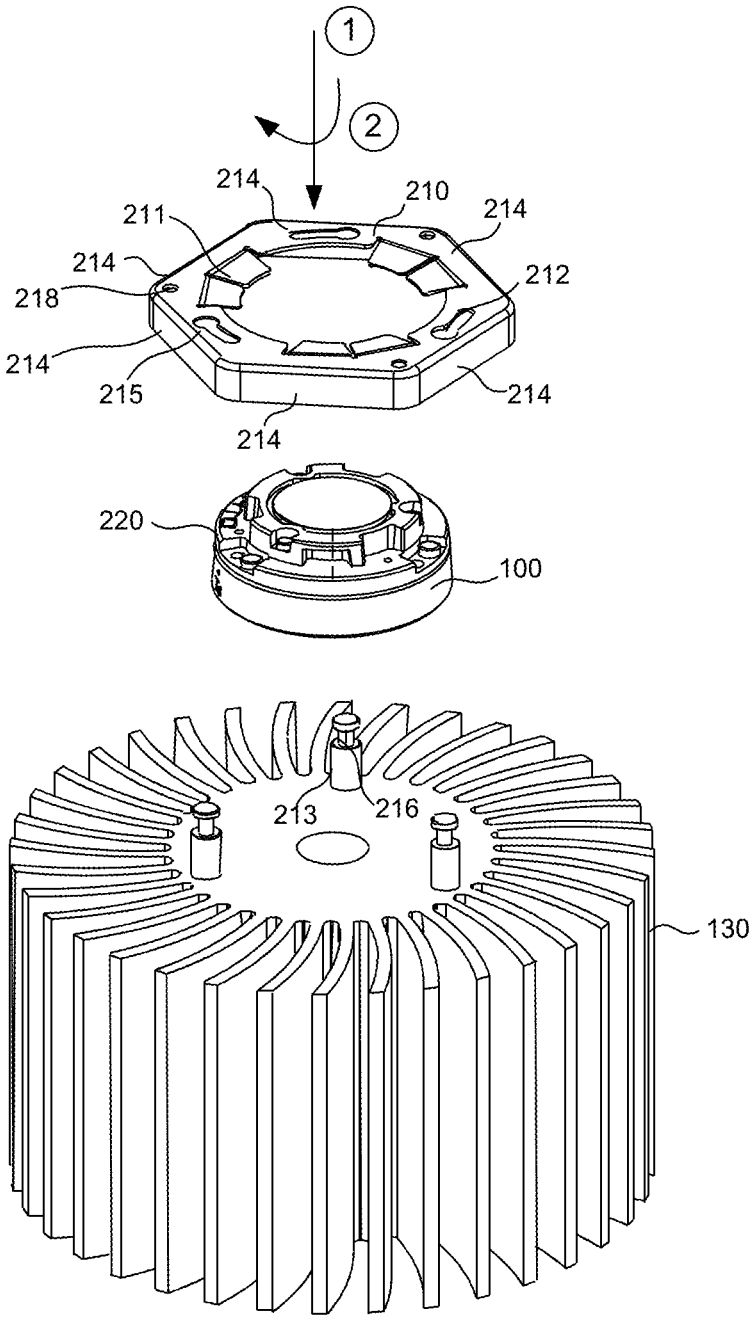
FIG. 22 illustrates mounting collar 210 including elastic members 211.

In other embodiments, mounting collar 210 may include slot features 212 instead of ramp features as discussed above. The slot feature is a cut-out feature that remains in plane with the top surface of collar 210 as depicted in FIG. 22. FIG. 22 illustrates mounting collar 210 including elastic members 211. In the illustrated embodiment, elastic members 211 are included as an integral part of mounting collar 210. For example, collar 210 may be a formed sheet metal part including elastic members 211 as part of the single formed sheet metal part. In other examples, elastic members 211 may be cast or molded as part of a single part mounting collar 210. Mounting collar 210 may optionally include tool feature 214. As illustrated tool feature 214 includes a plurality of surfaces of mounting collar 210. In the illustrated embodiment a complementary tool (e.g. socket and lever) may be employed to engage with the tool feature 214 of collar 210 to facilitate assembly and increase the torque that may be applied to collar 210. As depicted in FIG. 22, mounting collar 210 includes slot features 212. In the illustrated example, slot features 212 are formed into collar 210 (e.g. by stamping, molding, or casting).

In a first step, module 100 is captured by mounting collar 210 and aligned with heat sink 130. As illustrated, module 100 is placed within pins 213 and mounting collar 210 is placed over module 100. Mounting collar 210 includes through holes 215 at the beginning of each slot feature 212. In the aligned configuration, mounting collar 210 is placed over module 100 such that pins 213 pass through the through holes 215 of mounting collar 210. After elastic elements 211 come into contact with module 100, a force is applied to collar 210 in a direction normal to the bottom surface of module 100 that causes elements 211 to deform and generate a force to press module 100 and heat sink 130 together. In these embodiments, an aligned position is reached when the grooves 216 of pins 213 align in the normal direction with slot feature 212. In a second step, collar 210 is rotated with respect to heat sink 130 to a locked position. In these embodiments, grooves 216 slide within slot feature 212 and act to lock collar 210 to heat sink 130. As discussed above, collar 210 may be rotated directly by human hands, or alternatively with the assistance of a tool acting on tool feature 214 to increase the torque applied to mounting collar 210. As collar 210 is rotated, the grooves 216 of pins 213 engage with slot feature 212

Figure 23A:
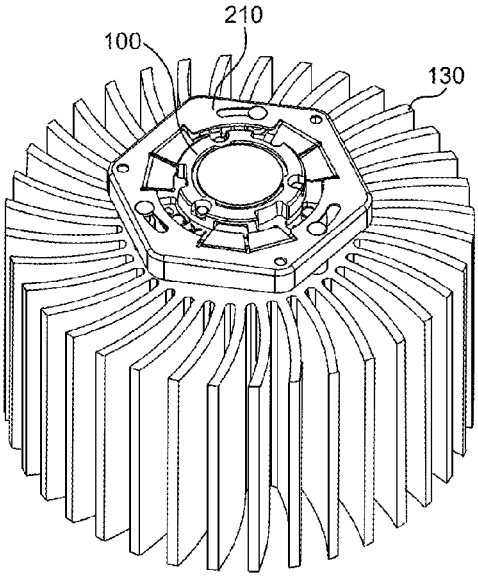
FIG. 23A illustrates mounting collar 210, module 100, and heat sink 130 in the aligned position.
Figure 23B:
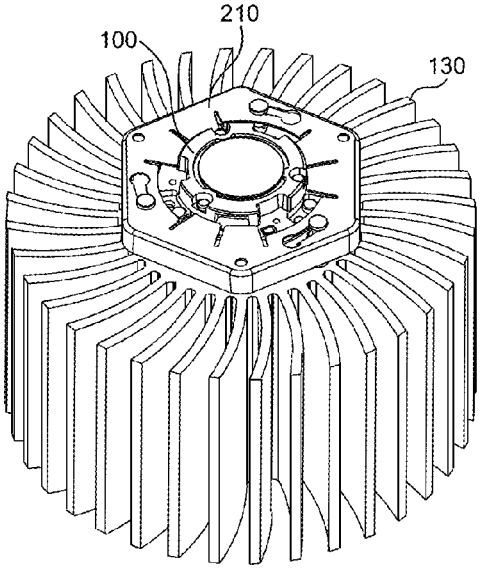
FIG. 23B illustrates mounting collar 210, module 100, and heat sink 130 in the fully engaged position after rotation of collar 210 with respect to heat sink 130.
Figure 24A:
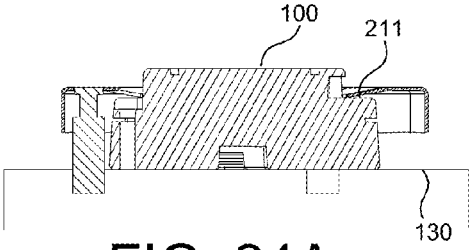
FIG. 24A illustrates a cross sectional view of FIG. 23A.
Figure 24B:
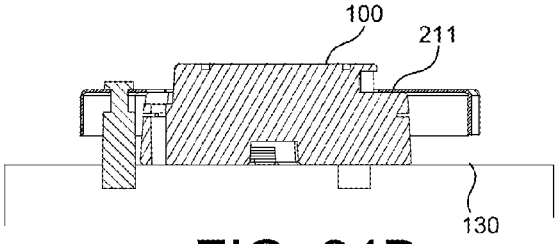
FIG. 24B illustrates a cross sectional view of FIG. 23B.
Figure 25A:
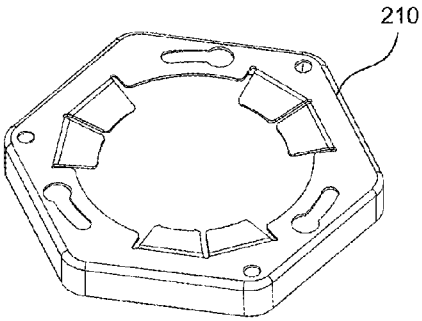
FIG. 25A illustrates a top, perspective view of mounting collar 210
Figure 25B:
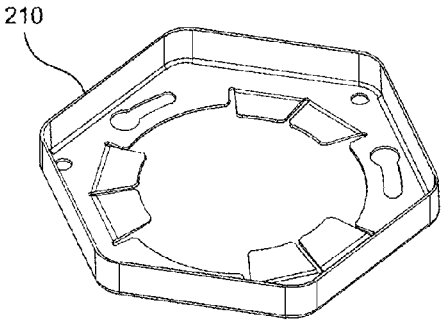
FIG. 25B illustrates a bottom, perspective view of collar 210.

FIG. 23A illustrates mounting collar 210, module 100, and heat sink 130 in the aligned position. FIG. 24A illustrates a cross sectional view of FIG. 23A. In the aligned position, elastic elements 211 are in contact module 100, but are not deformed. FIG. 23B illustrates mounting collar 210, module 100, and heat sink 130 in the fully engaged position after rotation of collar 210 with respect to heat sink 130. FIG. 24B illustrates a cross sectional view of FIG. 23B. In the fully engaged position, elastic elements 211 are in contact module 100 and are deformed. As discussed above, the deformation generates a force acting to press module 100 and heat sink 130 together. FIG. 25A illustrates a top, perspective view of mounting collar 210 and FIG. 25B illustrates a bottom, perspective view of collar 210.

Figure 26A:
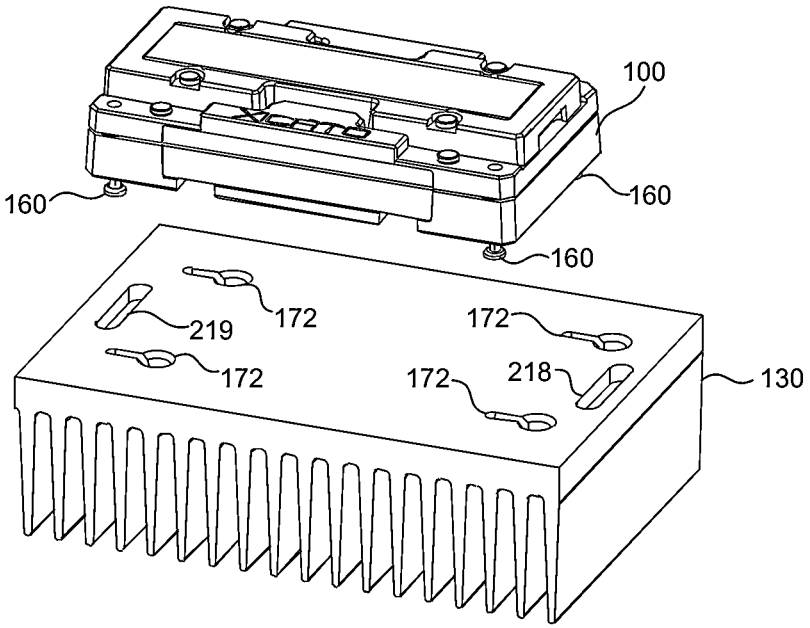
FIGS. 26A-26C illustrate an example of the first described embodiment of FIGS. 5-10C applied to a rectangular shaped illumination module.
Figure 26B:
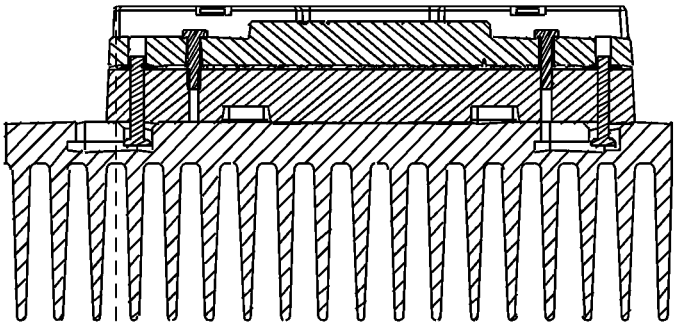
Figure 26C:
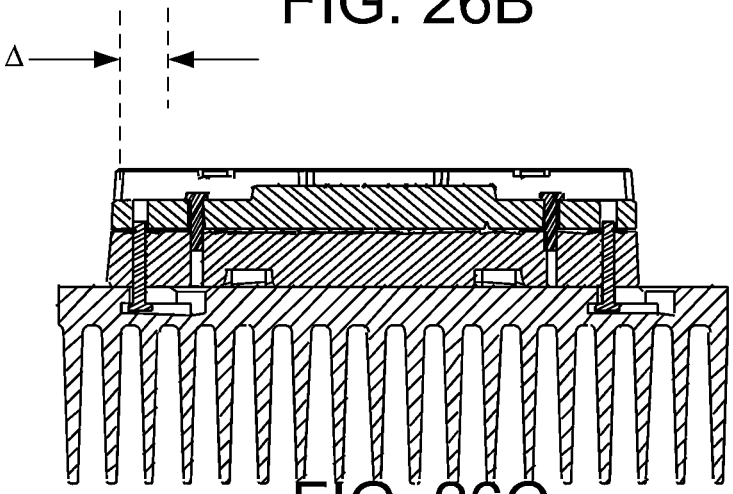

Although the embodiments discussed above have been depicted as operable to retain round shaped illumination modules against a light fixture, the embodiments are also applicable to retain polygonal shaped illumination modules within luminaires. FIGS. 26A-26C illustrate an example of the first described embodiment of FIGS. 5-10C applied to a rectangular shaped illumination module. FIG. 26A illustrates rectangular shaped illumination module 100 including spring pin assemblies 160 placed near the four corners of module 100. Heat sink 130 includes linearly cut ramped shoulder grooves 172. Shoulder grooves 172 are positioned on the face of heat sink 130 to correspond with spring pins 160. In a first step, illumination module 100 is aligned with heat sink 130. As illustrated in FIG. 26B, spring pins 160 are aligned with shoulder grooves 172 in the aligned position. In a second step, module 100 is translated with respect to heat sink 130 to couple module 100 to heat sink 130 as illustrated in FIG. 26C. In this engaged position, spring pin 162 is displaced by an amount, Δ. As a result of this displacement, spring 161 deforms (see FIGS. 10A-10C) and generates a restoring force in the direction opposite the displacement of pin 162. This restoring force acts to generate a compressive force between module 100 and heat sink 130. Groove 172 ramps downward from the face of heat sink 130 as it is linearly cut from the initial aligned position to the engaged position. As a result, pin 162 is displaced from module 100 as module 100 is translated from the aligned position to the engaged position.

Translating module 100 from the aligned position to the engaged position may be performed by human hands. However, in some embodiments, a tool may be employed to increase the amount of force applied to module 100. As illustrated in FIG. 26A, heat sink 130 includes tool features 218 and 219. In the depicted embodiment, tool features 218 and 219 are slots of heat sink 130. For example, the slots may be cast, machined, or molded into heat sink 130. The slots accommodate a flat blade tool (e.g. flat blade screwdriver) that is useable to increase the amount of force applied to module 100 when translating module 100 with respect to heats sink 130.

Figure 27:
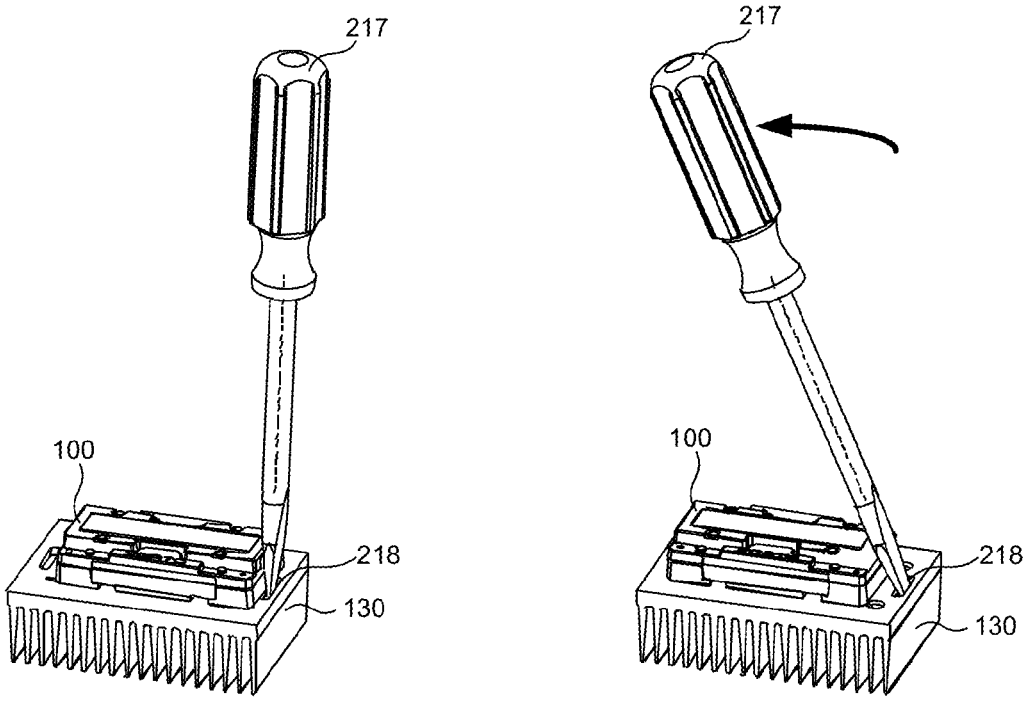
FIG. 27 illustrates the translation of module from the aligned position to the engaged position using tool engaged with tool feature.
Figure 28:
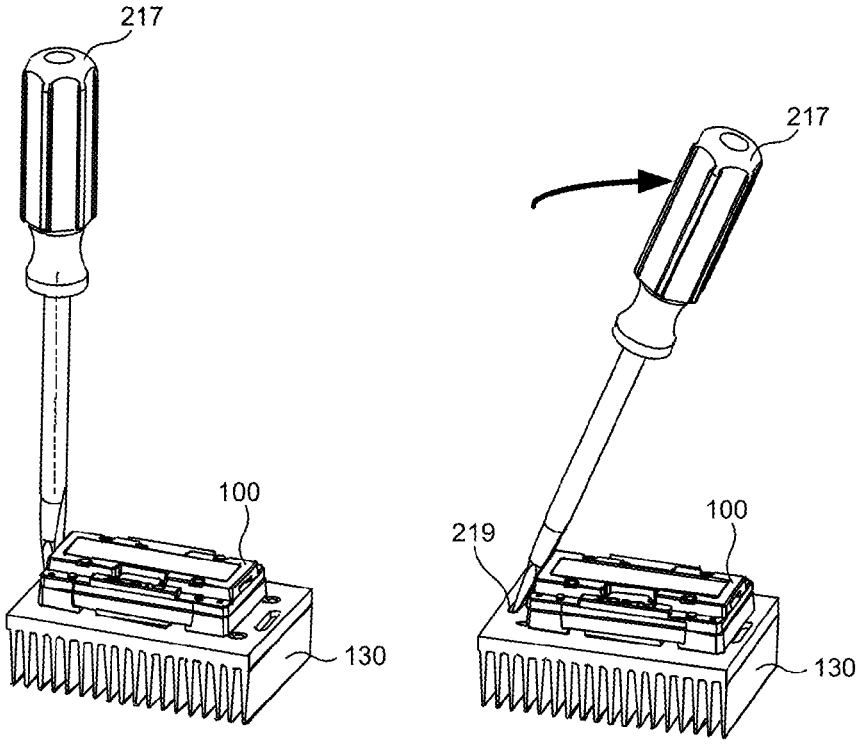
FIG. 28 depicts the translation of module from the engaged position to the aligned position using tool engaged with tool feature.

FIG. 27 illustrates the translation of module 100 from the aligned position to the engaged position using tool 217 engaged with tool feature 218. In the depicted example, tool 217 is a flat blade screwdriver. The blade of screwdriver 217 is inserted into tool feature 218 and then screwdriver 217 is rotated about the blade tip such that the shank of screwdriver 217 presses against module 100 and pushes module 100 from the aligned position to the engaged position as depicted. FIG. 28 depicts the translation of module 100 from the engaged position to the aligned position using tool 217 engaged with tool feature 219. In a similar manner as described above, but in the opposite direction, screwdriver 217 is used to push module 100 to the aligned position. Although, this example is depicted in the context of this particular embodiment, it may also be applied to any of the embodiments discussed in this patent document where a linear displacement is employed to engage module 100 with heat sink 130.

Figure 29A:
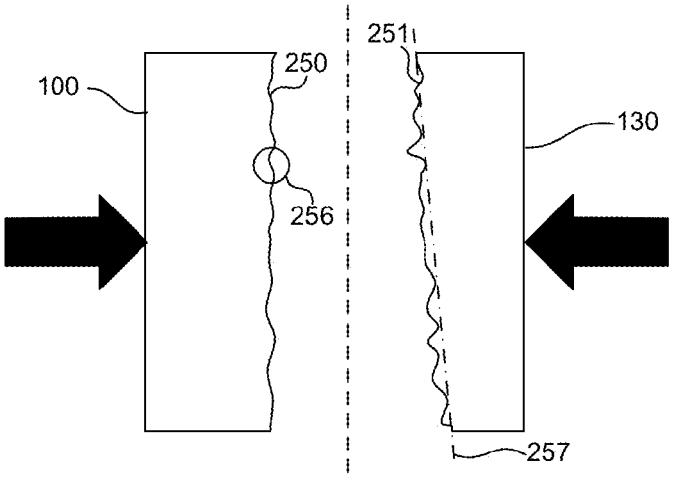
FIGS. 29A-29C illustrate thermal interface surfaces configured for improved thermal conductivity in the presence of manufacturing defects present on the interfacing surfaces.
Figure 29B:
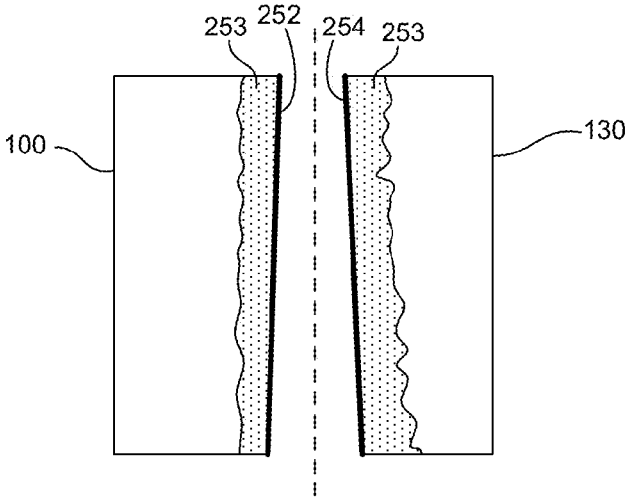
Figure 29C:
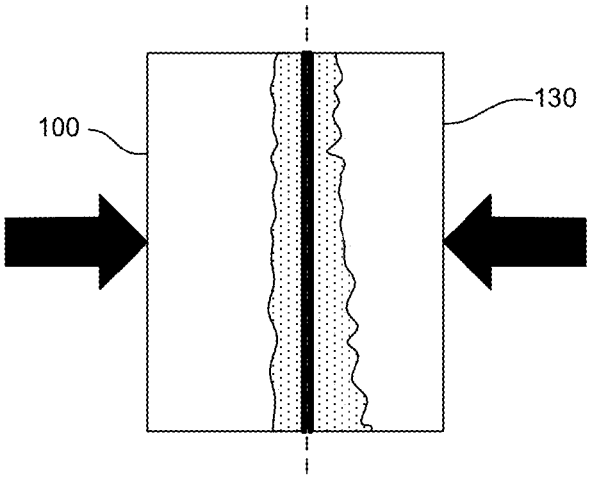

Although, the thermal interface surfaces of heat sink 130 and module 100 have been depicted as flat surfaces, non-ideal manufacturing conditions may cause surface variations that negatively impact heat transmission across their interface. FIGS. 29A-29C illustrate thermal interface surfaces configured for improved thermal conductivity in the presence of manufacturing defects present on the interfacing surfaces. FIG. 29A illustrates a portion 250 of a thermal interface surface of module 100 by way of example. Portion 250 may be a surface of a machined, molded, or cast part, or may be sawn from a larger part. These processes may result in surface imperfections that decrease the heat transmission possible across the surface. In some examples, the imperfections may be local incongruities in the surface as highlighted in portion 256. In other examples, the imperfection may be a surface unflatness or dimensional errors that result in a misalignment and limited contact surface area when the two surfaces 250 and 251 are brought together. FIG. 29B illustrates thin sheets 252 and 254 bonded to surfaces 250 and 251, respectively by bonding material 253. Bonding material 253 fills surface incongruities such as those illustrated in portion 256. Sheets 252 and 254 are made by processes such as sheet rolling that assure a high degree of surface flatness. By bonding sheet 252 to surface 250, a rough surface is replaced with a smooth, flat surface. When surfaces 252 and 254 are brought into contact, as illustrated in FIG. 29C, the amount of surface area at their interface is increased compared to the scenario when surfaces 250 and 251 are brought into contact. Surfaces 252 and 254 may also be repeatedly placed into contact and separated without having to clean and reapply conductive grease or pads, thus simplifying module replacement. Bonding material 253 is thermally conductive and acts to transfer heat between sheet surfaces 252 and 254 to surfaces 250 and 251, respectively. In addition, bonding material 253 is compliant. As surfaces 250 and 251 are pressed together, compliant bonding material 253 deforms such that flat surfaces 252 and 254 make full contact across the entire interface despite surface unflatness or dimensional errors that would normally limit their contact surface area to an amount less than their entire interface.

Figure 30A:
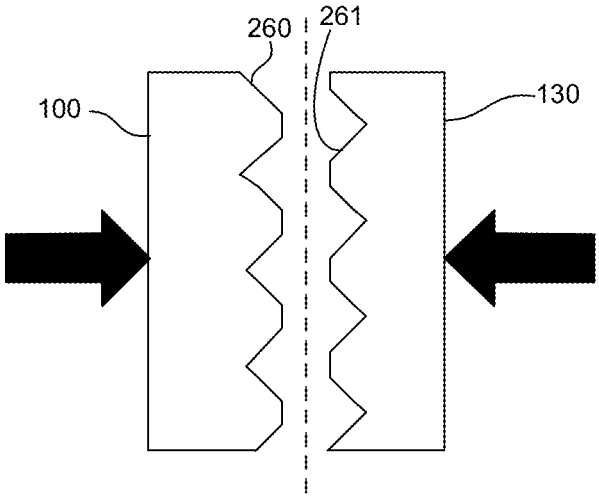
FIGS. 30A-B illustrate faceted thermal interface surfaces configured for improved thermal conductivity in the presence of contaminant particles.
Figure 30B:
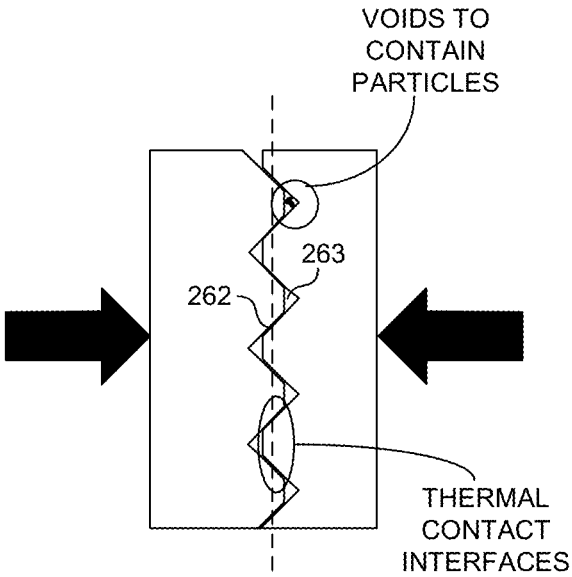

Although, the thermal interface surfaces of heat sink 130 and module 100 have been depicted as flat surfaces, non-ideal manufacturing conditions may allow surface contaminants to negatively impact heat transmission across their interface. FIGS. 30A-B illustrate faceted thermal interface surfaces configured for improved thermal conductivity in the presence of contaminant particles. FIG. 30A illustrates a portion 260 of a faceted thermal interface surface of module 100 in a cross-sectional view by way of example. Portion 260 may be a surface of a machined, molded, or cast part. As illustrated faceted surface 260 has a saw-tooth shape with repeated raised features extending from module 100. Each raised feature is flattened at the tip. Heat sink 130 includes a faceted thermal interface surface 261 with a complementary saw-tooth shaped pattern with repeated raised features extending from heat sink 130. FIG. 30B illustrates module 100 in contact with heat sink 130. As illustrated the repeated pattern of raised portions of interface surfaces 260 and 261 interlock and generate a repeated sequence of thermal contact interfaces 262. In addition, the repeated pattern of raised portions of interface surfaces 260 and 261 interlock and generate a repeated sequence of voids 263. The voids are generated because of the flattened portion at the top of each raised feature of interface surfaces 260 and 261. As surfaces 260 and 261 are brought into contact, surface contaminants become trapped within voids 263 rather than becoming trapped between thermal contact interfaces 262. Contaminant particles trapped between thermal contact interfaces 262 create separation at the thermal interface that impedes heat transmission across the interface. Contaminant particles filling voids 263 do not interfere with heat transmission across the interface. In this manner, faceted surfaces 260 and 261 are shaped to promote improved heat transmission across their interface by providing voids to trap contaminant particles that would otherwise be entrapped between surfaces 260 and 261 and reduce the thermal conductivity at their interface.

In many of the above-described embodiments, the thermal interface surfaces of heat sink 130 and module 100 have been depicted as being placed in direct contact. However, manufacturing defects in the interfacing surfaces of module 100 and heat sink 130 may limit the contact area at their thermal interface. However, in all described embodiments, a pliable, thermally conductive pad or thermally conductive paste may be employed between the two surfaces to enhance thermal conductivity. Furthermore, in all of the described embodiments, an intervening surface may be included between module 100 and heat sink 130. For example, as described with respect to the embodiment of FIGS. 13A and 13B, bottom member 188, sometimes referred to as intervening surface 188, may be positioned between the bottom of illumination module 100 and heat sink 130. To maintain low cost, heat sink 130 is often saw cut across its top and bottom surfaces from an extrusion. In other example, heat sink 130 may be crudely cast. In any of these scenarios, the dimensions and surface quality of the thermal interface surface of heat sink 130 is not adequately controlled to ensure sufficient contact area with module 100 for adequate thermal conductivity. Although thermally conductive pads or pastes may help address this deficiency, both pads and greases should be replaced each time a module is replaced. To eliminate the cost of this effort, intervening surface 188 may be introduced. Surface 188 is fixedly attached to heat sink 130 in a factory environment and should not have to be removed again during the operational life of luminaire 150. Conductive pads or pastes may be employed to ensure adequate heat conductivity across this interface without a significant cost penalty because surface 188 should not replaced. Surface 188 is a smaller, simpler part than heat sink 130 and the dimension and surface quality of the top side of surface 188 should be controlled with minimal added cost. With adequate controls the interface between the top side of surface 188 and module 100 has sufficient thermal conductivity without the use of conductive pads or pastes. Although an intervening surface has been described with respect to the embodiment of FIG. 11, an intervening surface may be employed as a part of any of the above-described embodiments.

Although many of the above-described embodiments have been depicted without reflectors for illustrative purposes, reflectors may be mounted to illumination module 100 as depicted in FIGS. 1 and 4 in any of the above-described embodiments. In addition, reflectors may be mounted to components of the above-described embodiments. For example, mounting collar 210 of FIG. 22 includes holes 218 to which a reflector may be attached. In other examples, a reflector may be heatstaked, welded, glued, or otherwise attached to components of the above-described embodiments. In other examples, a reflector retaining collar, such as collar 110 depicted in FIG. 4, may be adapted to any of the above-described embodiments.

In some examples, the amount of deflection, Δ, discussed with respect to the above-mentioned embodiments may be less than 1 millimeter. In other examples, the amount of deflection, Δ, discussed with respect to the above-mentioned embodiments may be less than 0.5 millimeter. In other examples, the amount of deflection, Δ, discussed with respect to the above-mentioned embodiments may be less than 10 millimeters.

Although certain specific embodiments are described above for instructional purposes, the teachings of this patent document have general applicability and are not limited to the specific embodiments described above. For example, module 100 is described as including mounting base 101. However, in some embodiments, base 101 may be excluded. In another example, module 100 is described as including an electrical interface module 120. However, in some embodiments, module 120 may be excluded. In these embodiments, mounting board 104 may be connected to conductors from light fixture 130. In another example, LED based illumination module 100 is depicted in FIGS. 1-2 as a part of a luminaire 150. However, LED based illumination module 100 may be a part of a replacement lamp or retrofit lamp or may be shaped as a replacement lamp or retrofit lamp. Accordingly, various modifications, adaptations, and combinations of various features of the described embodiments can be practiced without departing from the scope of the invention as set forth in the claims.

What is claimed is:

1. An apparatus comprising:

a mounting collar including a first member comprising a plurality of elastic members and a second member adapted to be fixed to a light fixture, wherein the first member is moveable with respect to the second member from a disengaged to an engaged position, and wherein a movement to an engaged position generates a compressive force between an LED based illumination module and the light fixture.

2. The apparatus of claim 1, wherein the LED based illumination module comprises a first thermal interface surface and the light fixture comprises a second thermal interface surface, and wherein the movement to the engaged position generates a compressive force between the first thermal interface surface and the second thermal interface surface.

3. The apparatus of claim 1, further comprising:

a thermally conductive pad disposed between the first and second thermal interface surfaces.

4. The apparatus of claim 1, wherein the first interface surface is a faceted surface with a first surface area, wherein a first portion of the first surface area contacts the second interface surface when the first and second interface surfaces are brought into contact, and wherein a second portion of the first surface area does not contact the second interface surface when the first and second interface surfaces are brought into contact generating a void between the first and second interface surfaces.

5. The apparatus of claim 4, wherein the second interface surface is a second faceted surface with a second surface area, wherein a first portion of the second surface area contacts the first interface surface when the first and second interface surfaces are brought into contact, and wherein a second portion of the second surface area does not contact the first interface surface when the first and second interface surfaces are brought into contact generating the void between the first and second interface surfaces.

6. The apparatus of claim 1, wherein any of the first thermal interface surface and the second thermal interface surface is a thin sheet flexibly bonded to the illumination module.

7. An apparatus comprising:

an LED based illumination module with a first thermal interface surface; and a mounting collar including a first member comprising a plurality of elastic members and a second member fixed to a light fixture, wherein the first member is moveable with respect to the second member from a disengaged to an engaged position, and wherein a movement to an engaged position generates a compressive force between an LED based illumination module and the light fixture.

8. The apparatus of claim 7, wherein the light fixture includes a second thermal interface surface.

9. The apparatus of claim 8, further comprising:

a thermally conductive pad disposed between the first and second thermal interface surfaces.

10. The apparatus of claim 7, wherein the first interface surface is a thin sheet flexibly bonded to the LED based illumination module.

11. The apparatus of claim 10, wherein the second interface surface is a thin sheet flexibly bonded to the light fixture.

12. An LED based illumination module mounting interface comprising:

an elastic mount coupled to a light fixture, wherein an LED based illumination module is removably attached to the light fixture and pressed against the elastic mount, and wherein the elastic mount provides a restoring force.

13. The LED based illumination module mounting interface of claim 12, further comprising:

an LED based illumination module with a first thermal interface surface; and a second thermal interface surface, wherein the elastic mount includes a first member and a second member with a plurality of elastic mounting members, wherein the elastic mount is operable to capture the LED based illumination module by a movement of the first member relative to the second member, and wherein the movement deforms the plurality of elastic mounting members and generates a compressive force between the first and the second thermal interface surfaces.

14. The LED based illumination module mounting interface of claim 13, further comprising:

a hinge element coupled to first and second members of the elastic mount.

15. The LED based illumination module mounting interface of claim 13, further comprising:

a buckle, wherein the buckle fixedly couples the first member to the second member in an engaged position.

16. The LED based illumination module mounting interface of claim 13, wherein any of the elastic mount and a light fixture includes the second thermal interface surface.

17. The LED based illumination module mounting interface of claim 16, further comprising a thermally conductive pad disposed between the first and second thermal interface surfaces.

18. The LED based illumination module mounting interface of claim 13, wherein any of the first thermal interface surface and the second thermal interface surface is a thin sheet flexibly bonded to the illumination module.

19. The LED based illumination module mounting interface of claim 13, wherein the first interface surface is a faceted surface with a first surface area, wherein a first portion of the first surface area contacts the second interface surface when the first and second interface surfaces are brought into contact, and wherein a second portion of the first surface area does not contact the second interface surface when the first and second interface surfaces are brought into contact generating a void between the first and second interface surfaces.

20. The LED based illumination module mounting interface of claim 19, wherein the second interface surface is a second faceted surface with a second surface area, wherein a first portion of the second surface area contacts the first interface surface when the first and second interface surfaces are brought into contact, and wherein a second portion of the second surface area does not contact the first interface surface when the first and second interface surfaces are brought into contact generating the void between the first and second interface surfaces.

* * * * *